US009677267B2

(12) United States Patent
Munz et al.

(10) Patent No.: US 9,677,267 B2
(45) **Date of Patent: *Jun. 13, 2017**

(54) CONSTRUCTION BLOCKS AND SYSTEMS

(71) Applicant: Block Florida, LLC, Homestead, FL (US)

(72) Inventors: Charles P. Munz, Homestead, FL (US); Angel J. Borrero, Miami, FL (US); Robert Clifford Scott, Homestead, FL (US)

(73) Assignee: Block Florida, LLC, Homestead, FL (US)

( * ) Notice: Subject to any disclaimer, the term of this patent is extended or adjusted under 35 U.S.C. 154(b) by 45 days.

This patent is subject to a terminal disclaimer.

(21) Appl. No.: 14/791,970

(22) Filed: Jul. 6, 2015

(65) Prior Publication Data

US 2016/0108614 A1 Apr. 21, 2016

Related U.S. Application Data

(63) Continuation of application No. 14/515,157, filed on Oct. 15, 2014, now Pat. No. 9,074,362.

(51) Int. Cl.
*E04C 2/04* (2006.01)
*E04B 2/02* (2006.01)
(Continued)

(52) U.S. Cl.
CPC ..... *E04B 2/02* (2013.01); *E04B 1/04* (2013.01); *E04B 2/08* (2013.01); *E04B 2/14* (2013.01); *E04B 2/18* (2013.01); *E04B 2/22* (2013.01); *E04B 2/24* (2013.01); *E04B 2/50* (2013.01); *E04B 2/52* (2013.01); *E04C 1/39* (2013.01);
(Continued)

(58) Field of Classification Search
CPC ..... E04B 2/08; E04B 2/12; E04B 2/18; E04B 2/22; E04B 2/44; E04C 1/00; E04C 1/397
See application file for complete search history.

(56) References Cited

U.S. PATENT DOCUMENTS 1,072,293 A 9/1913 Ziemet
1,606,150 A 11/1926 Curtis
(Continued)

FOREIGN PATENT DOCUMENTS

BR PI 0401250-0 A 11/2001
CN 202809613 U 3/2013
(Continued)

OTHER PUBLICATIONS

Meyer Lok Block LLC—http://meyerlokblock.com/details.php.
(Continued)

*Primary Examiner* — Joshua J Michener
*Assistant Examiner* — Keith Minter
(74) *Attorney, Agent, or Firm* — Akerman LLP

(57) ABSTRACT

A semi-interlocking construction block system may include blocks having prism shaped male and female fittings configured for semi-interlocking interaction. When mated the male and female fittings may engage along their respective interfacing upper bases and lower ends of their respective lateral side faces. Gaps may be defined between upper ends of their respective lateral side faces. The fittings may include arcuate edges which may be quarter rounded.

20 Claims, 30 Drawing Sheets

(51) Int. Cl.

| | |
|---|---|
| ***E04B 1/04*** | (2006.01) |
| ***E04B 2/14*** | (2006.01) |
| ***E04C 1/39*** | (2006.01) |
| ***E04B 2/08*** | (2006.01) |
| ***E04B 2/18*** | (2006.01) |
| ***E04B 2/22*** | (2006.01) |
| ***E04B 2/24*** | (2006.01) |
| ***E04B 2/50*** | (2006.01) |
| ***E04B 2/52*** | (2006.01) |

(52) U.S. Cl.
CPC ..... *E04C 1/397* (2013.01); *E04B 2002/0208* (2013.01); *E04B 2002/0213* (2013.01); *E04B 2002/0217* (2013.01); *E04B 2002/0219* (2013.01); *E04B 2002/0263* (2013.01); *E04B 2002/0289* (2013.01)

(56) References Cited

U.S. PATENT DOCUMENTS

| | | | | |
|---|---|---|---|---|
| 2,114,244 | A | 4/1938 | Zoettl | |
| 2,141,397 | A | 12/1938 | Locke | |
| 2,184,682 | A | 12/1939 | Sentrop | |
| 2,206,205 | A | 7/1940 | Selby | |
| 2,308,790 | A | 1/1943 | Stagg | |
| 2,392,551 | A | 1/1946 | Roe | |
| 2,736,188 | A | 2/1956 | Wilhelm | |
| 2,861,388 | A | 11/1958 | Favaretto | |
| 3,618,279 | A | 11/1971 | Sease | |
| 3,717,967 | A | 2/1973 | Wood | |
| 3,822,569 | A | 7/1974 | Lautrup-Larsen | |
| 3,962,842 | A | 6/1976 | Wilhelm | |
| 3,968,615 | A | 7/1976 | Ivany | |
| 4,015,391 | A | 4/1977 | Epstein et al. | |
| 4,075,808 | A | 2/1978 | Pearlman | |
| 4,167,840 | A | 9/1979 | Ivany | |
| 4,314,431 | A * | 2/1982 | Rabassa | E04B 2/46 52/259 |
| 4,320,606 | A | 3/1982 | GangaRao | |
| 4,473,985 | A | 10/1984 | Hunt | |
| 4,597,236 | A | 7/1986 | Braxton | |
| 4,643,427 | A | 2/1987 | Wozniak | |
| 4,726,567 | A | 2/1988 | Greenberg | |
| 5,277,580 | A * | 1/1994 | Miskolczi, Jr. | F27D 1/04 110/336 |
| 5,365,714 | A | 11/1994 | Potvin | |
| 5,507,127 | A | 4/1996 | Gates | |
| 5,711,130 | A | 1/1998 | Shatley | |
| 6,065,265 | A | 5/2000 | Stenekes | |
| 6,082,067 | A | 7/2000 | Bott | |
| 6,098,357 | A | 8/2000 | Franklin et al. | |
| 6,122,881 | A | 9/2000 | Aubertot | |
| 6,226,951 | B1 | 5/2001 | Azar | |
| 6,244,009 | B1 | 6/2001 | Cerrato | |
| D464,441 | S | 10/2002 | Lucaces | |
| 6,588,168 | B2 | 7/2003 | Walters | |
| 6,735,913 | B2 | 5/2004 | Sanders et al. | |
| 7,007,436 | B1 | 3/2006 | Kelley | |
| 7,117,647 | B2 | 10/2006 | Clarke | |
| 7,337,589 | B2 * | 3/2008 | Meyer | E04B 2/18 52/286 |
| 7,461,490 | B2 | 12/2008 | Toledo | |
| 7,584,584 | B2 | 9/2009 | Fennell, Jr. | |
| 7,882,674 | B2 | 2/2011 | Craven et al. | |
| 8,061,095 | B2 | 11/2011 | Bucheger | |
| 8,266,855 | B1 | 9/2012 | Altararwah | |
| 8,464,482 | B2 | 6/2013 | Raynor | |
| 8,667,760 | B2 | 3/2014 | Drew | |
| 9,074,362 | B1 * | 7/2015 | Munz | E04B 2/18 |
| 2002/0021042 | A1 | 2/2002 | Damron | |
| 2002/0043038 | A1 | 4/2002 | Cerrato | |
| 2003/0070386 | A1 | 4/2003 | Hampton | |
| 2003/0070388 | A1 | 4/2003 | Catani et al. | |
| 2004/0020145 | A1 | 2/2004 | Matsufuji | |
| 2005/0102950 | A1 | 5/2005 | Knudson et al. | |
| 2005/0108972 | A1 | 5/2005 | Banova | |
| 2005/0115185 | A1 | 6/2005 | Telford et al. | |
| 2005/0252118 | A1 | 11/2005 | Matsufuji | |
| 2005/0284077 | A1 | 12/2005 | Spratlen et al. | |
| 2006/0000179 | A1 | 1/2006 | Albert | |
| 2006/0059839 | A1 | 3/2006 | Azar | |
| 2006/0168907 | A1 | 8/2006 | Thorpe | |
| 2007/0056235 | A1 | 3/2007 | Kohler | |
| 2007/0094989 | A1 * | 5/2007 | Scheker | E04B 2/16 52/596 |
| 2007/0107364 | A1 | 5/2007 | Estes et al. | |
| 2007/0245673 | A1 | 10/2007 | Cerrato | |
| 2007/0271868 | A1 * | 11/2007 | Abella | E04B 2/08 52/600 |
| 2008/0047219 | A1 | 2/2008 | Donohew | |
| 2008/0120931 | A1 | 5/2008 | Joslyn | |
| 2009/0025333 | A1 | 1/2009 | Moroschan | |
| 2009/0113836 | A1 | 5/2009 | Pitchers et al. | |
| 2009/0188186 | A1 | 7/2009 | Ebanks | |
| 2009/0235606 | A1 | 9/2009 | Ness et al. | |
| 2010/0043335 | A1 * | 2/2010 | O'Connor | E04B 2/16 52/592.6 |
| 2011/0247289 | A1 | 10/2011 | Schmidt | |
| 2013/0276400 | A1 * | 10/2013 | Genest | E04C 1/00 52/600 |
| 2013/0333313 | A1 | 12/2013 | Alsayed et al. | |
| 2014/0007529 | A1 * | 1/2014 | Alvarez Moysen | E04B 2/18 52/220.2 |
| 2014/0053493 | A1 | 2/2014 | Carey | |
| 2014/0059962 | A1 | 3/2014 | O'Connor | |
| 2014/0059965 | A1 * | 3/2014 | Edwards | E04B 2/16 52/588.1 |
| 2014/0223848 | A1 | 8/2014 | Binhussain et al. | |

FOREIGN PATENT DOCUMENTS

| | | | |
|---|---|---|---|
| DE | 19733484 | A1 | 2/1999 |
| WO | 2010/013991 | A1 | 2/2010 |
| WO | 2012104685 | A1 | 8/2012 |

OTHER PUBLICATIONS

Pune, Maharashtra, M.S. Cement Blocks, http://indiamart.com//mscement-blocks/constructions-materials.html.
International Search Report issued in connection with corresponding PCT Application No. PCT/US2015/055430.
Written Opinion issued in connection with corresponding PCT Application No. PCT/US2015/055430.

* cited by examiner

CONSTRUCTION BLOCKS AND SYSTEMS

CROSS-REFERENCE TO RELATED APPLICATION

This patent application is a continuation-in-part of co-pending U.S. patent application Ser. No. 14/515,157, entitled CONSTRUCTION BLOCKS AND SYSTEMS, filed Oct. 15, 2014, the contents of which are herein incorporated by reference in their entirety.

TECHNICAL FIELD

The present disclosure relates generally to field of construction materials and systems. In particular, the present disclosure relates to blocks and interfacing surfaces for constructing structural units.

BACKGROUND

Structures are commonly constructed using building materials that include blocks. The blocks are typically stacked and aligned with adhesion materials positioned between interfacing surfaces of the blocks. The structural integrity of such structures may be compromised due to, for example, sliding, foundation shifts, wind shear, impacts, and earthquakes. Engineering tradeoffs are often made with respect to the material and skilled labor costs available for a particular project, which may impact the strength and long term integrity of the structure.

What is needed are generally applicable eloquent block design solutions that balance structural concerns with that of reasonable project costs.

SUMMARY

In one aspect, a semi-interlocking construction block system includes a first block and a second block. The first block may have a prism shaped male fitting positioned at a first face of the first block. The male fitting may comprise lateral and longitudinal lower edges extending along the first face of the first block and define a lower base, lateral and longitudinal upper edges defining an upper base, lateral side faces having lower ends extending from the lateral lower edges and upper ends extending to the lateral upper edges, and longitudinal side faces having lower ends extending from the longitudinal lower edges and upper ends extending to the lateral upper edges. The second block may have a prism shaped female fitting defined in a first block face of the second block. The female fitting may comprise lateral lower edges extending along the first face of the second block between longitudinal ends of the female fitting and defining a lower base opening therebetween, lateral side faces extending between the longitudinal ends of the female fitting and having lower ends extending from the lateral lower edges and upper ends extending to arcuate lateral upper edges, and an upper base extending between the longitudinal ends and the arcuate lateral upper edges. When mated, the male and female fittings may engage along respective upper bases and lower ends of the lateral side faces and gaps may be defined between the upper ends of the lateral side faces of the male fitting and the arcuate lateral upper edges and the upper ends of the lateral side faces of the female fitting.

In various embodiments, the lateral upper edges of the male fitting may be arcuate, the first face of the first block may extend between a first and a second longitudinal end of the first block, and the male fitting may extend along the first face of the first block between the first and second longitudinal ends. The first block, the second block, or both may further comprise a passageway extending longitudinally through the block. The passageway may define a cross-section that is arcuate or rectangular.

In one embodiment, the second block may further comprise extensions extending from a second face of the second block, opposite of the first, wherein the extensions define a slot dimensioned to receive a beam. The second block may further define a hollow core extending between the first face and the second face of the second block. The hollow core may be configured to receive a column therein transverse to the beam. In one embodiment, the longitudinal side faces of the male fitting are trapezoidal shaped. The lateral side faces of the male fitting may be trapezoidal shaped. The gaps may further extend along the upper and lower ends of the longitudinal side faces of the male fitting when mated. In one embodiment, the male fitting may be located at a first end of the first face of the first block. The first block may further comprise a second male fitting, same as the first, located at a second end of the first face of the first block. The first block may further comprise a hollow core positioned between the male fittings and extending between the first face and a second face of the first block, opposite the first, dimensioned to receive a column. The female fitting may be located at a first end of the first face of the second block. The second block may further comprise a second female fitting, same as the first, located at a second end of the first face of the second block and positioned to mate with the second male fitting of the first block. The second block may further comprise a hollow core positioned between the female fittings and extending between the first face and a second face of the second block, opposite the first, and configured to align with the hollow core of the first block when the male and female fittings mate. The hollow cores of the first and second block may have arcuate edges. In one embodiment, both the first block and second block have a second face, opposite their respective first face, and at least one of the second face of the first block or the second face of the second block does not define a corresponding male or female fitting. In one embodiment, the at least one of the second face or the first block and the second face of the second block that does not define a corresponding male or female fitting may define a substantially flat surface extending along its lateral and longitudinal length. In one embodiment, the male fitting is laterally offset along the first face. In one embodiment, both the first block and the second block have a second face, opposite the first, and opposing third and fourth faces extending between the first face and the second face. The third face and the fourth face of at least one of the first block and the second block may respectively define an outer corner and an inner corner.

In another aspect, a construction block configured for semi-interlocking interaction comprises a block body, a prism shaped male fitting, and a female fitting. The block body may have a first face positioned at a first end and a second face positioned at a second end. The prism shaped male fitting may protrude from the first face and comprise lateral and longitudinal lower edges extending along the first face, lateral and longitudinal side faces having lower ends and upper ends. The lower ends may extend from respective lateral and longitudinal lower edges and the upper ends extend to respective lateral and longitudinal upper edges, and an upper base that may be defined between the lateral and longitudinal upper edges and be positioned a first vertical distance from the first face. The lateral and longitudinal side faces may be trapezoidal and a perimeter of the lateral and longitudinal lower edges may be greater than a perimeter of the lateral and longitudinal upper edges. The female fitting may be defined in the second face and comprise lateral lower edges extending along the second face and defining a lower base opening therebetween, lateral side faces extending between longitudinal ends of the female fitting and having lower ends extending from the lateral lower edges and upper ends extending to arcuate lateral upper edges, and an upper base positioned a second vertical distance from the second face and extending between the longitudinal ends and the arcuate lateral upper edges. The first and second vertical distances may be substantially the same. A distance between the lower ends of the lateral side faces of the female fitting may be substantially the same as a distance between the lower ends of the lateral side faces of the male fitting. A distance between the upper ends of the lateral side faces of the female fitting may be greater than a distance between the upper ends of the lateral side faces of the male fitting.

The block may further define a hollow core extending between the first face and the second face. The hollow core may be configured to receive a column therein. The male fitting and female fitting may be laterally offset along the first face and the second face. The block may have opposing third and fourth faces extending between the first face and the second face wherein the third face defines an outer corner and the fourth face defines an inner corner.

In yet another aspect, a method of forming a structure comprises positioning a first block and a second block in semi-interlocking engagement. The positioning may comprise mating a prism shaped male fitting of the first block and a prism shaped female fitting of the second block. The male fitting may be formed on a first face of the first block. The male fitting may comprise lateral and longitudinal lower edges extending along the first face of the first block and defining a lower base, lateral and longitudinal upper edges defining an upper base, lateral side faces having lower ends extending from the lateral lower edges and upper ends extending to the lateral upper edges, and longitudinal side faces having lower ends extending from the longitudinal lower edges and upper ends extending to the lateral upper edges. The female fitting may be defined in a first block face of the second block and comprise lateral lower edges extending along the first face of the second block between longitudinal ends of the female fitting and defining a lower base opening therebetween, lateral side faces extending between the longitudinal ends of the female fitting and having lower ends extending from the lateral lower edges and upper ends extending to arcuate lateral upper edges, and an upper base extending between the longitudinal ends and the arcuate lateral upper edges. When mated, the male and female fittings may engage along respective upper bases and lower ends of the lateral side faces and gaps may be defined between the upper ends of the lateral side faces of the male fitting and the arcuate lateral upper edges and the upper ends of the lateral side faces of the female fitting.

In one embodiment, the method further comprises applying an adhesive to one or both of the male fitting and the female fitting prior to mating the male fitting and female fitting. When mated, at least a portion of the adhesive may be positioned within the gaps defined between the upper ends of the lateral side faces of the male fitting and the arcuate lateral upper edges and the upper ends of the lateral side faces of the female fitting.

BRIEF DESCRIPTION OF THE DRAWINGS

The features and advantages of this invention, and the manner of attaining them, will become more apparent and the invention itself will be better understood by reference to the following description of embodiments of the invention taken in conjunction with the accompanying drawings, wherein.

DESCRIPTION

Figure 1:
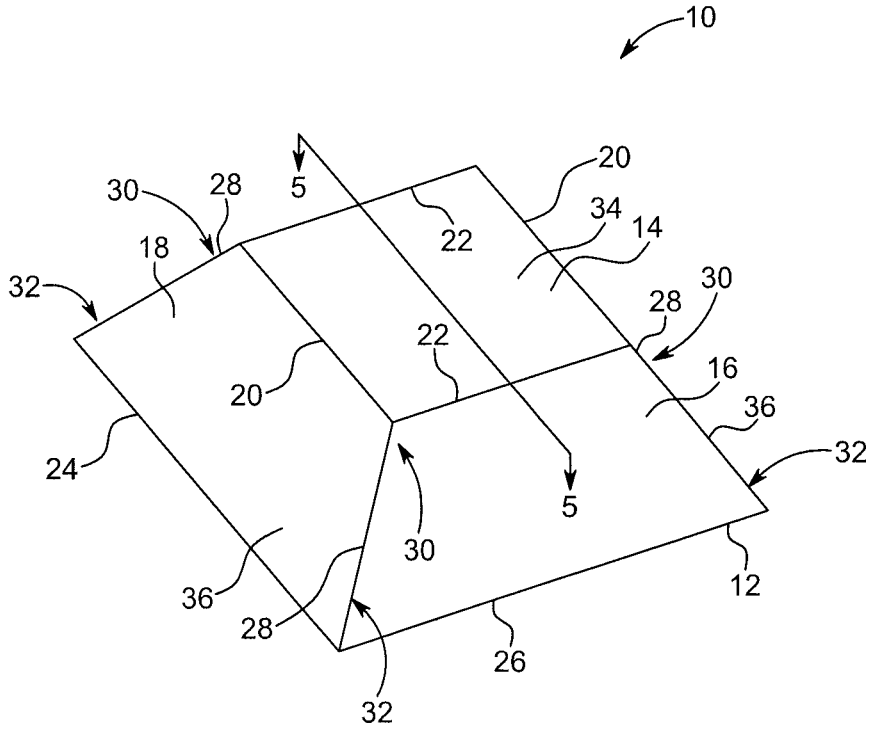
FIG. 1 is a perspective view of a male trapezoidal fitting according to various embodiments described herein.

According to various embodiments, construction blocks and building block systems comprising construction blocks configured to interact via interlocking or semi-interlocking interaction are disclosed. The blocks may generally include one or more fittings positioned at, e.g., formed on or defined in, one or more faces of the block. The block faces and fittings comprise dimensions configured to interface with one or more dimensions of block faces and fittings of one or multiple additional blocks. For example, the blocks may include various surface features dimensioned to provide a suitable stable association between interfacing blocks. Various fittings may be configured to mate with fittings having different dimensions such that the fit, .e.g., interlocking or semi-interlocking, of the fittings may be manipulated or modified for particular applications or purposes.

In one embodiment, the fittings comprise prism shaped fittings, e.g., trapezoidal key or keyway fittings, configured to interface in a locking or semi-interlocking manner. The fittings may include male and female fittings. For example, male fittings may comprise a prism shaped fitting formed on a face of a block configured to be received in or mated with a female fitting comprising a prism shaped defined in the face of a block. The male fitting may include one or more dimensions complementary with one or more dimensions of a female fitting such that the complementary dimensions engage when the fittings are mated. For example, in one embodiment, the male fitting defines an outer dimension substantially matching that of an inner dimension defined in the female fitting. In some embodiments, the male fitting may defined semi-complementary with that of a female fitting. For example, the male and female fitting may include complementary dimensions and non- or semi-complementary such that when the fittings are mated fitting portions having complementary dimensions engage and gaps may be formed between mated fitting portions having non- or semi-complementary dimensions. Such non- or semi-complementary dimensions will generally be positioned between complementary dimensions or be such that the particular dimensions do not interfere with the interaction or engagement of respective complementary dimensions.

According to various embodiments, blocks may be configured to interact to form a structural unit having increased compressive and tensile strength and durability while also limiting shifting, for example, from wind shear or impacts and withstand slight shifting from quakes or vibrates that put a structure composed of one or more blocks at risk.

Blocks configured according to the present disclosure may be configured to include a variety of block designs including standard block or brick dimensions, e.g., full, half, wide, etc. Blocks may also be dimensioned to include corner, offset, or tie features. The blocks may be sized to include structural dimensions familiar to masons, such as those associated with traditional concrete masonry units. For example, the block system may include blocks having overall or peripheral dimensions generally corresponding to or adaptable to those of traditional construction blocks. Accordingly, in one embodiment, the block system comprises blocks configured to retrofit existing structures. As such, the block system may be used in conjunction with current structures utilizing dimensions in common use to repair, renovate, or increase the soundness of existing structures without requiring complete deconstruction, demolition, excavation, or rebuild, for example. However, the block system and blocks for use with the block system are not so limited and may be configured or adaptable to any convenient dimensional configuration such as those generally larger or smaller than those traditionally available or utilized. Indeed, the block system is not limited by peripheral dimensions and may provide beneficial flexibility in this regard.

The blocks may be preferably constructed from cement or similar materials including composites or other suitable construction materials. However, those having skill in the art will recognize upon reading the present disclosure that while the material selected may typically be selected within the structural, aesthetic, or financial confines of a project using recognized engineering standards, the blocks disclosed herein find wide applicability and may be constructed in whole or in part from any suitable material such as stone, wood, ceramics, metallics, composites, polymers, etc. In one embodiment, suitable blocks may be formed of a precast concrete product configured for construction. However, in some embodiments, the blocks may be cast onsite for incorporation into the building structure. Those skilled in the art will appreciate upon reading this disclosure that the beneficial features described herein may be applied to a wide variety of blocks configurations and dimensions.

Blocks may be used as construction materials to construct structures such as walls, barriers, supports, etc. For example, the blocks may be configured to be positioned adjacent to one another such that block faces or associated fittings positioned or defined thereon interface when the blocks are stacked, aligned, etc. In one embodiment, interaction between such blocks may be assisted with an adhesive material, e.g., mortar. The adhesive material may be applied along interfacing portions of the block faces and fittings, which may place the material within gaps formed between non- or semi-complementary dimensions of interfaced fittings. In at least one embodiment, however, various blocks may be configured to be interfaced without adhesive material, e.g., grout or mortar may not be needed along interfacing portions of the block faces or fittings including within gaps.

In one embodiment, a first block includes one or more prism shaped male trapezoidal key fittings. The fittings may be positioned along one or more faces of the block, e.g., at a upper, lower, lateral, or longitudinal end of the block. A second block may be configured to interface with the first block at the male fitting along one or more prism shaped female trapezoidal keyway fitting defined in the second block, e.g., at a upper, lower, lateral, or longitudinal end of the block. One or both of the male and female fittings may extend the length of the respective block. For example, in one embodiment, the male fitting may extend a portion of the length of the first block and the female fitting may extend along a corresponding portion, when mated, of the second block or may extend the entire length of the corresponding portion of the second block. The first and second block may also include additional male or female fittings. For example, such fittings may be positioned on block faces that are located on the same, adjacent, or opposite ends of the block. In one embodiment, the first and second blocks include male fittings positioned at upper ends and female fittings positioned at lower ends. It is to be appreciated that in some embodiments, upper ends may include female fittings and the lower ends may include male fittings.

In various embodiments, the male and female fittings may be configured for semi-interlocking interaction. In one configuration, one or both male and female fitting may be shaped with quarter round edges. In one embodiment, a block or block system includes fittings having a matched height and different side angles, edges, or base lengths configured to form gaps along the side faces of the fitting when mated. For example, in one embodiment, female fittings include rounded edges for mating with male fittings with substantially straight angled edges. The male fittings may include side faces having trapezoidal dimensions. The side faces may extend between upper and lower bases of the fitting at an angle to the vertical. For example, in one configuration, a trapezoidal side face positioned at a longitudinal end may not be flush with an adjacent block face at the longitudinal end of the block or a block comprising the female fitting to which the male fitting is mated.

In various embodiments, the block system may include blocks defining one or more hollow core portions. The hollow core portions may extend vertically, laterally, or longitudinal through the core region of the block. Such hollow core portions may comprise openings, passageways, bores, or chases, for example, that may be utilized to accommodate additional construction materials such as reinforcement materials, plumbing, electrical, insulation, or the like as well as accessory features such as deodorizers, sensors, industrial systems, or the like. The hollow core portions may also beneficially reduce the amount of block material expended to form the blocks of the block system. In some instances, blocks having hollow core portions may impact strength of a structure incorporating such blocks. In many instances, however, the maximum amount of strength that may be provided by solid blocks may be unnecessary, for example where building height, load, impacts, or natural disaster are not significant factors in the engineering analysis. Additionally, where building materials and untrained labor are scarce, the block system may be utilized to build a serviceable structure comprising interlocking blocks having solid cores or hollow core portions stacked on a level surface. However, according to various embodiments, the block system and blocks described herein may be configured with hollow core portions while providing increased structural strength compared to traditional blocks having standard web designs. For example, hollow core portions may comprise, e.g., oval or circular cavities, to distribute loads or stresses. Hollow core portions may define any suitable cross section such as regular, irregular, geometric, or non-geometric. The sides of the hollow core portions may be straight or curved and may be coupled between straight or curved edges. In at least one embodiment, arcuate or curved edges may be configured to increase structural strength of the block compared to traditional blocks with standard web designs. Arcuate or curved edges may comprise rounded edges, such as quarter rounded edges.

In one embodiment, for example, a block or the block system includes a block body having a general or peripheral block size comprising nominal or actual dimensions of four inches by eight inches by sixteen inches, a net cross sectional area of twenty-four square inches, and a critical shell section dimension of two by (three quarter inches by sixteen inches), based on minimum shell thickens on each side of the block between a longitudinally extending hollow core portion and a block face. In one embodiment, a block or the block system includes a block body having a general or peripheral block size comprising nominal or actual dimensions of eight inches by eight inches by sixteen inches, a net cross sectional area of sixty-four square inches, and a critical shell section dimension of two by (two inches by sixteen inches), based on minimum shell thickens on each side of the block between a longitudinally extending hollow core portion and a block face. In one embodiment, a block or the block system includes a block body having a general or peripheral block size comprising nominal or actual dimensions of twelve inches by eight inches by sixteen inches, a net cross sectional area of eighty-eight square inches, and a critical shell section dimension of two by (two and three quarters inches by sixteen inches), based on minimum shell thickens on each side of the block between a longitudinally extending hollow core portion and a block face.

Blocks comprising semi-interlocking fittings, e.g., prism shaped trapezoidal key or keyways, including female fittings having arcuate or rounded edges as described herein may prevent block shifting from wind shear, impacts of force, or broken truss kickback movement under a tie beam. Such block fitting may further prevent settling cracks and may withstand slight shifting from quakes, sonic booms, vibrations, or natural events that may threaten the structure. The structure may be stronger, safer, and less vulnerable to destruction or degradation. The structure may further benefit from more comprehensive strength due to the design of the blocks and additional cohesion area in square inches compared to conventional blocks. In various embodiments, blocks and structures constructed from the blocks or block systems described herein meet or exceed the stringent standards of the Miami-Dade County Building Code with respect to web type concrete blocks. Compared to traditional blocks, the blocks of the block system may also be configured to be laid more simplistically as the application of mortar or adhesive may be minimal allowing for less waste of mortar and less labor.

In various embodiments, the block system may be utilized in residential, civil, commercial, subterranean, marine, etc. structures. For example, the block system may be utilized in construction of homes, such as single family homes, privacy walls, seawalls, traffic separators, utility sheds, barns, high-rise construction, commercial structures, such as warehouses, shopping centers, malls, stores, or any other suitable structure that may require robust construction or otherwise benefit from the block system. For example, the block system may utilize concrete or similar materials to form the blocks of the block system. These materials in combination with the block configurations described herein may be used for any application conventional cement blocks may achieve as well as many other uses which are yet to be designed or may be considered unsuitable for conventional concrete blocks because of the engineering advantages of the present blocks and block system. Upon reading this disclosure, those having skill in the art will appreciate that the present blocks and block system may be especially beneficial in geographic areas challenged by natural disasters or adverse weather conditions.

Among the various applications of the blocks and block system described herein are large scaled block versions that may be used as traffic separators with water jackets or compartments to cushion crashes; construction of tunnel overpass structures; construction of septic drain-field with holes in lower sections; construction of large water distribution systems; construction of conduits for force-mains, gas-mains providing concrete protection from vandals and terrorists in gas and oil distribution lines; construction of concrete conduits for underground electrical transmission lines; construction of underground protection from tornadoes or nuclear explosions, e.g., bomb shelters; construction with vertical attachment to exterior walls for roof-drains; limited and large scale retention walls along hillsides to retain mud or earth and for preventing landslides; and construction of tunnels and overhead bypass structures, e.g., for golf carts on golf courses.

FIG. 1 illustrates one embodiment of a prism shaped male key fitting 10 having trapezoidal dimensions according to various embodiments. The male fitting 10 may include a lower base 12 and an upper base 14 having side faces 16, 18 positioned therebetween. The upper base 14 is positioned between lateral upper edges 20 and longitudinal upper edges 22. The lower base 12 is positioned between lateral lower edges 24 and longitudinal lower edges 26. The side faces 16, 18 include a pair of longitudinal side faces 16 coupled at side edges 28 to a pair of lateral side faces 18 and define a perimeter of the fitting 10. The longitudinal side faces 16, lateral side faces 18, and side edges 28 connect with the upper base 14 at upper ends 30 and with the lower base 12 at lower ends 32.

In various embodiments, the upper base 14 further includes an engagement surface 34 configured to engagingly interface with an adjacent surface of a female fitting when mated thereto, as described in more detail below. The lower ends 32 of the lateral side faces 18 may also include engagement surfaces 36 configured to engagingly interface with an adjacent side wall of the female fitting 40 when mated therein, as also described in more detail below.

The male fitting 10 may have a prism shape that includes one or more generally trapezoidal side faces. For example, the upper base 14 and lower base 12 may have generally rectangular or square dimensions. The lower base 12 may also occupy an area greater than the upper base 14. For example, an area of the lower base 12 defined between the longitudinal lower edges 26 and lateral lower edges 24 may be less than an area of the upper base 14 defined between the longitudinal upper edges 22 and lateral upper edges 20. The longitudinal upper edges 22 may extend a greater length than the lateral upper edges 20. In at least one embodiment, the longitudinal upper edges 22 may extend a lesser length than the lateral upper edges 20. In various embodiments, both the longitudinal side faces 16 and lateral side faces 18 comprise trapezoidal dimensions. In other embodiments, the lateral side faces 18 may comprise other dimensions such as rectangular dimensions. As shown, the longitudinal side faces 16 and lateral side faces 18 have generally trapezoidal shaped dimensions wherein adjacent side edges 28 extend inwardly with respect to the fitting at an angle from a vertical and toward one another from respective lower ends 32 to respective the upper ends 30.

Figure 2:
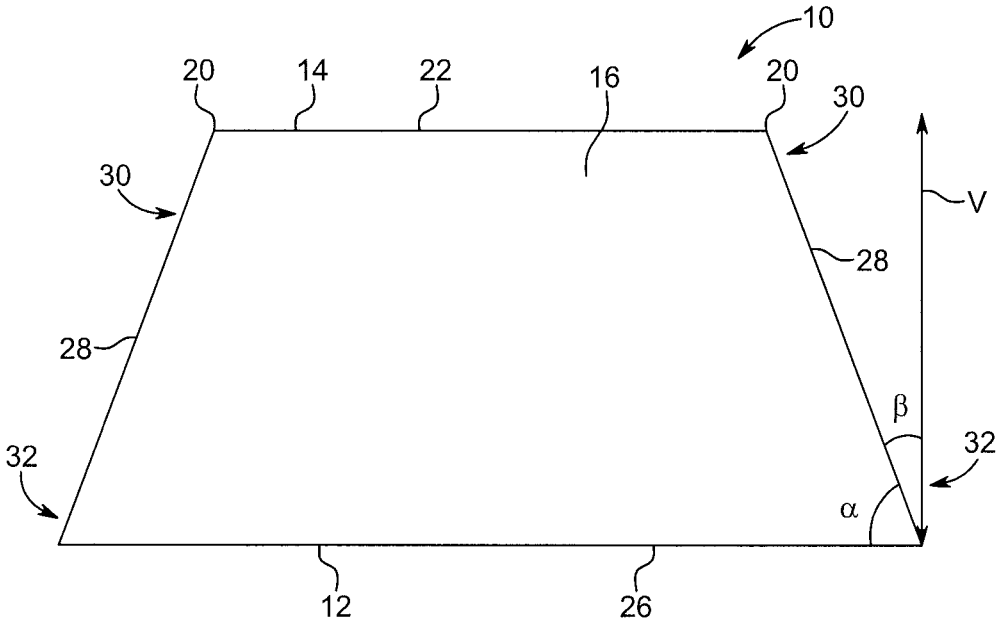
FIG. 2 is a side view of the male fitting of FIG. 1 according to various embodiments described herein.
Figure 3:
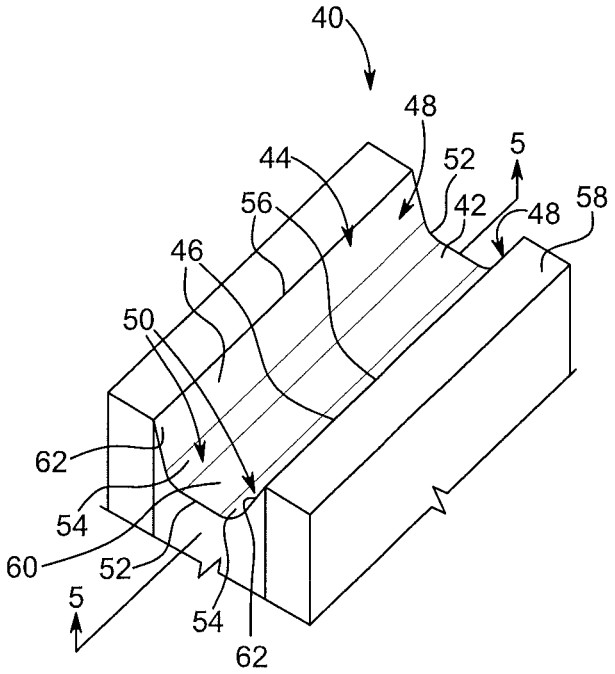
FIG. 3 is a perspective view of a female trapezoidal fitting according to various embodiments described herein.

FIG. 2 provides a side view of the male fitting 10 shown in FIG. 1 illustrating the trapezoidal shaped dimensions of one of the longitudinal side faces 16. A distance between the upper ends 30 of the side edges 28 and length of the longitudinal upper edge 22 are less than a distance between the lower ends 32 of the side edges 28 and length of the lower longitudinal lower edge 26. The legs 28 form an angle $\alpha$ with the lower base 12 along the longitudinal lower edge 26 that is less than 90° and hence is complementary to an angle $\beta$ formed with vertical V. FIG. 3 illustrates a prism shaped female trapezoidal keyway fitting 40 according to various embodiments. The female fitting 40 may be dimensioned to receive and thereupon mate with a male fitting, such as the male fitting 10 described with respect to FIGS. 1 & 2. The female fitting 40 may include an upper base 42 and a lower base opening 44. Laterally opposed walls or side faces 46 may extend from upper ends 50 positioned adjacent to the upper base 42 to lower ends 48 positioned adjacent to the lower base opening 44. The upper base 42 may be longitudinally defined between longitudinal edges 52 positioned at longitudinal ends of the female fitting and laterally along lateral edges, which are illustrated as arcuate edges 54, positioned between the upper base 42 and the side faces 46. The side faces 46 may be longitudinally defined between the longitudinal edges 52 and vertically between the arcuate edges 54 and lower edges 56 positioned between the lower end 48 of each side face 46 and a face 58 of the block in which the female fitting 40 is defined.

Together, the upper base 42, side faces 46, and a plane extending along the lower base opening 44 between the lower ends 48 of the side faces 46 may define a prism. The side faces 46 may be positioned to angle outwardly of the vertical, away from each other, from their lower ends 48 to their upper ends 50. The side faces 46 may also define generally rectangular shaped areas. The upper base 42 and the lower base opening 44 may define generally rectangular shaped areas. A cross-section of the female fitting 40 may thus define a general trapezoidal shape or profile at a longitudinal end of the fitting 40 having arcuate edges 54 extending between the side faces 46 and the upper base 42. For example, an area of the upper base 42 may be less than an area of the lower base opening 44.

Figure 4:
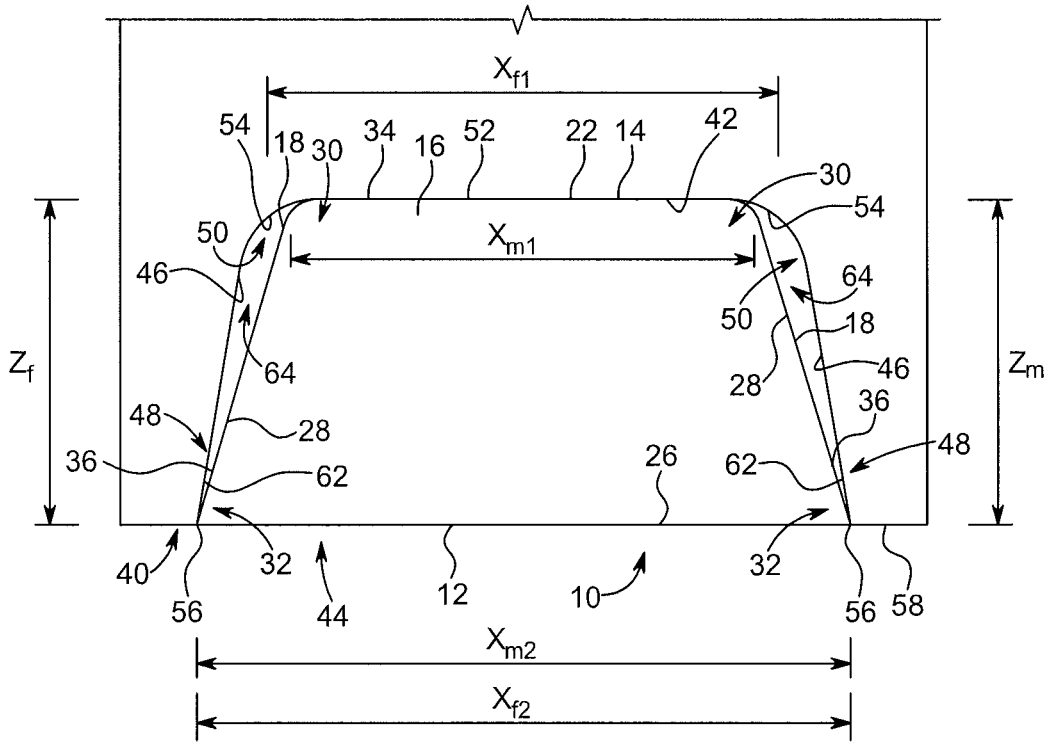
FIG. 4 is a side view of the male fitting of FIG. 1 mated with the female fitting 40 of FIG. 3 according to various embodiments described herein.

FIG. 4 illustrates a side view of the male fitting 10 shown in FIGS. 1 & 2 mated with the female fitting 40 shown in FIG. 3. The male fitting 10 is configured for semi-interlocking interaction with the female fitting 40. When mated, laterally positioned and longitudinally extending gaps 64 are formed between the interfacing opposed side faces 46 of the female fitting 40 and the lateral side faces 18 of the male fitting 10.

The height $Z_m$ of the male fitting 10 and the height $Z_f$ of the female fitting 40 may be substantially the same or such that the upper bases 14, 42 at least partially engage along respective engagement surfaces 34, 60 when mated. A lateral length $X_{m1}$ of the upper base 14 of the male fitting 10 may be less than or the same as a lateral $X_{f1}$ the upper base 42 of the female fitting 40. For example, the engagement surface 32 of the upper base 14 of the male fitting 10 may be configured to engage the corresponding engagement surface 62 of the female fitting 40 that may extend toward a foot of each arcuate edge 54. The arcuate edges 54 may be positioned at lateral ends of the upper base 42 and upper ends 50 of the side walls such that the lateral ends arc toward and meet with the upper ends 50 of the side faces 46 which may similarly arc toward the lateral ends of the upper base 42. The angle in which the lateral side faces 18 of the male fitting 10 intersect with the lower base 12 of the male fitting 10 along the lateral lower edges 24 may be less than an angle in which the lower ends 48 of the side faces 46 of the female fitting 40 extend from the lower base opening 44 toward the upper base 42.

A lateral length $X_{f2}$ extending between the lower ends 48 of the side faces 46 and lower edge 56 along the lower base opening 44 may correspond to a lateral length $X_{m2}$ of the longitudinal lower edges 26 such that engagement surfaces 62 along the lower ends 48 of the side faces 46 and engagement surfaces 34 along the lower ends 32 of the lateral side faces 18 compliment and engage when the fittings 10, 40 are mated. Thus, the engagement surfaces 34 positioned along the lower ends 32 of the lateral side faces 18 of the male fitting 10 may engage the corresponding engagement surfaces 62 positioned along the lower ends 48 of the side faces 46 to limit slipping in the lateral direction.

Figure 5:
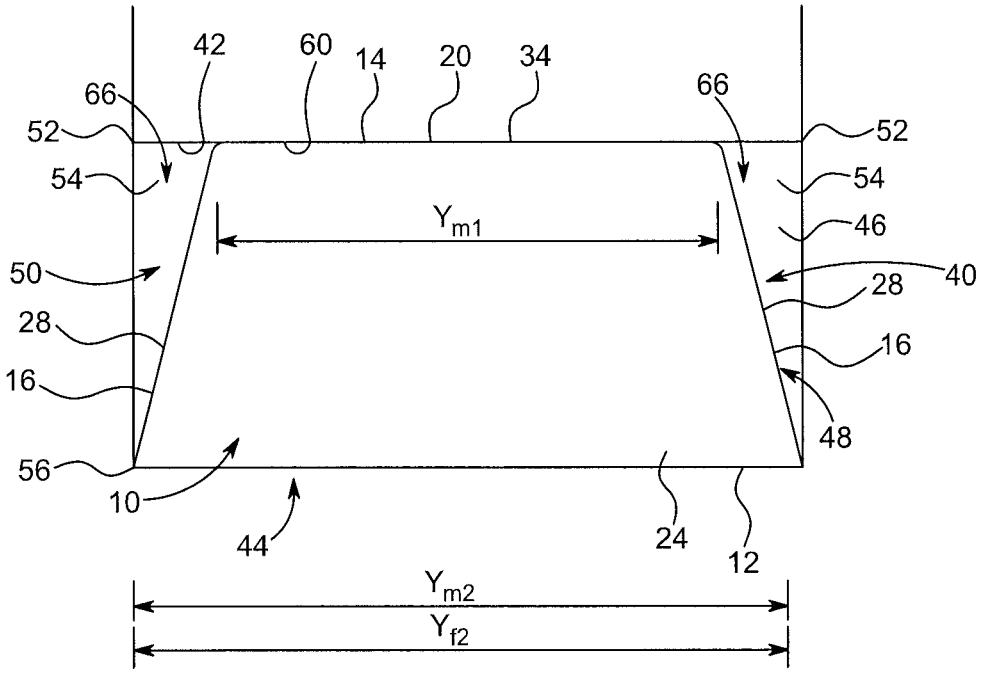
FIG. 5 is a cross-sectional view of the male fitting 10 of FIG. 1 mated with the female fitting 40 of FIG. 3 taken along line 4 in FIGS. 1 & 3 according to various embodiments described herein.

FIG. 5 illustrates a cross-section view of the mated male fitting 10 and female fittings 40 shown in FIG. 4, taken along line 5 of FIGS. 1 & 3. The upper base 14 and side faces 16, 18 of the male fitting 10 are shown received within the female fitting 40 such that longitudinally positioned and laterally extending gaps 66 are positioned between upper ends 50 of the side faces 46 of the female fitting 40 and the longitudinal side faces 16 of the male fitting 10. In this embodiment, the upper base of the female fitting 40 overhangs the length of the longitudinal side faces 16. A longitudinal length $Y_f$ of the female fitting 40 may be greater than a longitudinal length $Y_{m1}$ of the upper lateral edges 20 of the male fitting 10. A longitudinal length $Y_{m2}$ of the lateral lower edge 24 extending longitudinally along the lower base 12 of the male fitting 10 may be substantially the same or greater than the longitudinal length $Y_f$ of the female fitting 40. In other embodiments, however, lengths $Y_{m1}$ of the lateral upper and lower edges 20, 24 of the male fitting 10 may each be less than the longitudinal length $Y_f$ of the female fitting along the lower edge 56 and upper base 42. In at least one embodiment, the longitudinal length $Y_{m2}$ of the lower lateral edge 24 of the male fitting 10 is greater than the longitudinal length $Y_f$ of the lower edge 56 of the female fitting 40.

In other embodiments (not shown), the upper base 42 and side faces 46 of the female fitting may meet at vertices extending along the longitudinal length $Y_f$ of the female fitting 40 rather than along the arcuate edges 54. For example, the vertices may be formed between adjacent portions of the upper base 42 and side faces 46, e.g., lateral ends of the upper base 42 and upper ends 50 of the side faces 46, that extend at substantially straight angles or define substantially flat surfaces that meet at the vertices. In one such embodiment, the lateral ends of the upper base 42 may meet the upper ends 50 of side faces 46 at a vertex forming a substantially straight edge extending along the longitudinal length $Y_f$ of the female fitting 40. The angle defined by the upper base 42, edge, and side face 46 may be 90° or greater. In a further embodiment, the angle defined by the upper base 42, edge, and side face 42 may be substantially the same, greater than, or less than an angle defined by the upper base 12 and the lateral side faces 18 of a corresponding male fitting 10, either on a same block or a block the female fitting 40 is configured to mate. For example, a lateral length $X_{m1}$ along the upper base 12 of the male fitting 10 may be less than a lateral length $X_{f1}$ along the upper base 42 of the female fitting 40. The lateral length $X_{f1}$ along the upper base 42 of the female fitting 40 may be greater than the lateral length $X_{m1}$ along the upper base 14 of the male fitting 10 but less than the lateral length $X_{m2}$ along the lower base 12 of the male fitting 10 such that a gap is formed between the upper ends 30 of the lateral side faces 18 of the male fitting 10 and the upper ends 50 of the side faces 46 of the female fitting 40 if mated. Similar to that described with respect to FIG. 4, a lateral length $X_{f2}$ extending between the lower ends 48 of the side faces 46 and lower edge 56 along the lower base opening 44 may correspond to a lateral length $X_{m2}$ of the longitudinal lower edges 26 such that engagement surfaces 62 along the lower ends 48 of the side faces 46 and engagement surfaces 34 along the lower ends 32 of the lateral side faces 18 compliment and engage when the fittings 10, 40 are mated. Thus, the engagement surfaces 34 positioned along the lower ends 32 of the lateral side faces 18 of the male fitting 10 may engage the corresponding engagement surfaces 62 positioned along the lower ends 48 of the side faces 46 to limit slipping in the lateral direction. In a further embodiment, the upper end 50 of the side face 46 may extend from the vertices at a substantially straight angle or along a substantially flat surface and a concave portion may be defined between the upper end 50 and the lower end 48 such that the lower end 48 along the engagement surface 62 is positioned complementary to engagement surface 34 of the male fitting 10 for engagement therealong if mated.

Figure 9A:
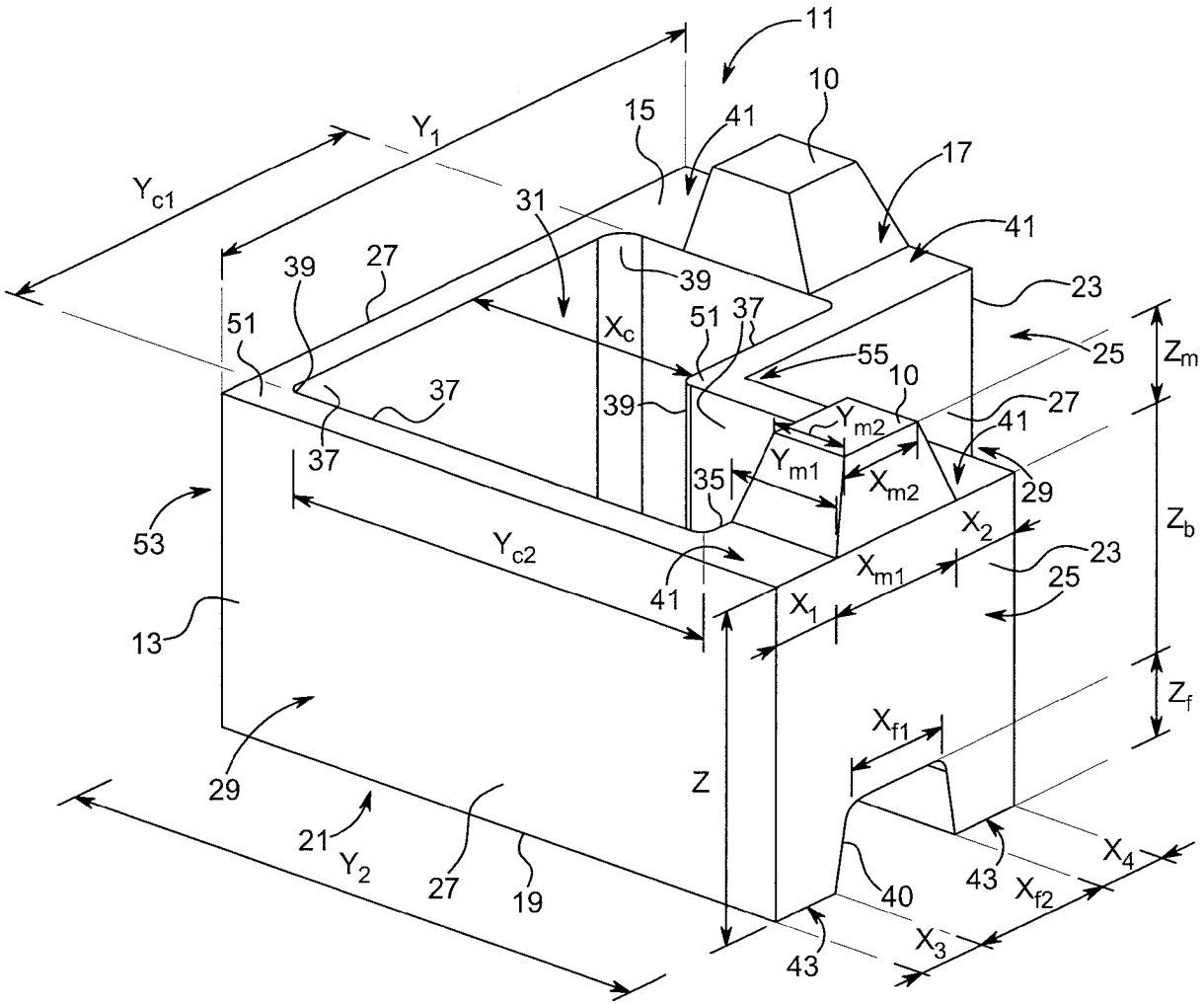
FIG. 9A is a perspective view of a corner column block according to various embodiments described herein.
Figure 9B:
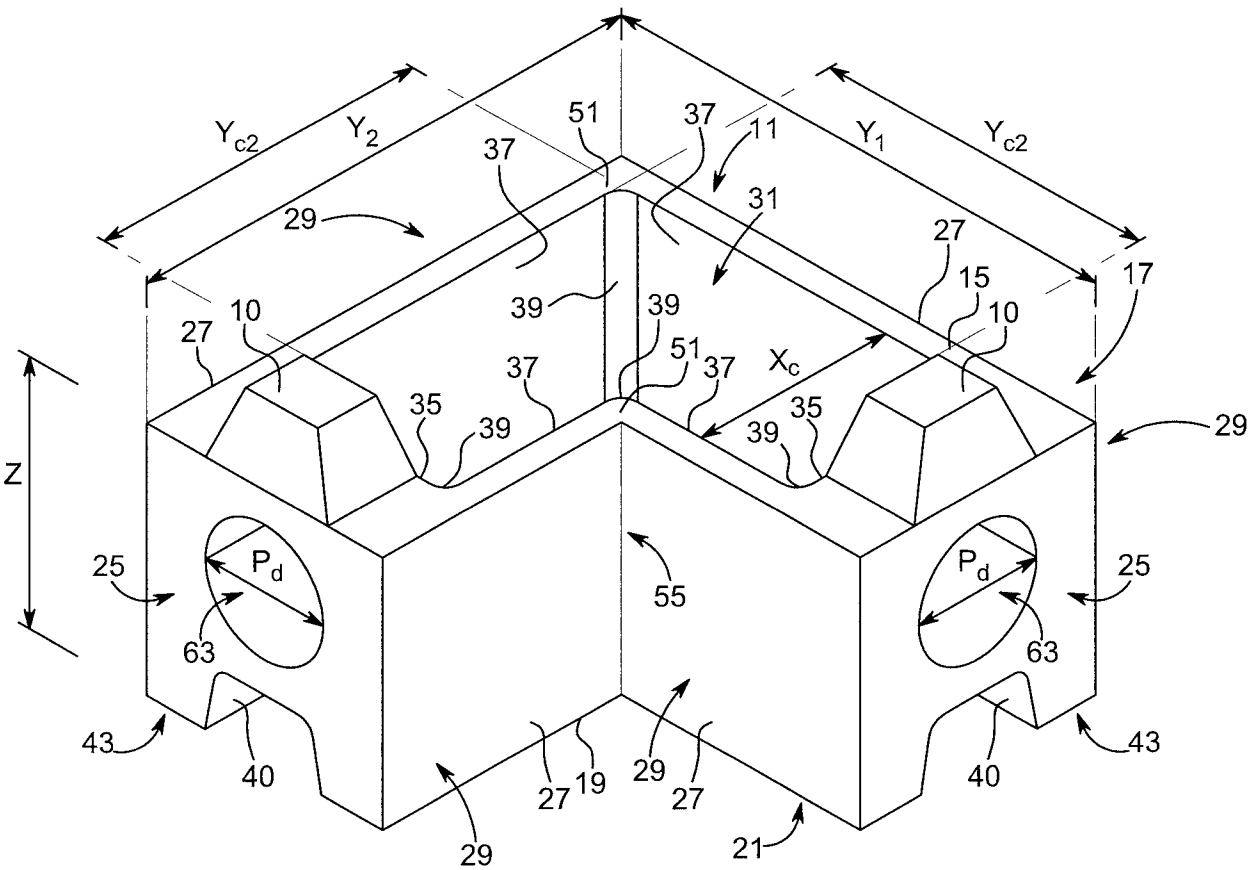
FIG. 9B is a perspective view of a corner column block according to various embodiments described herein.
Figure 9C:
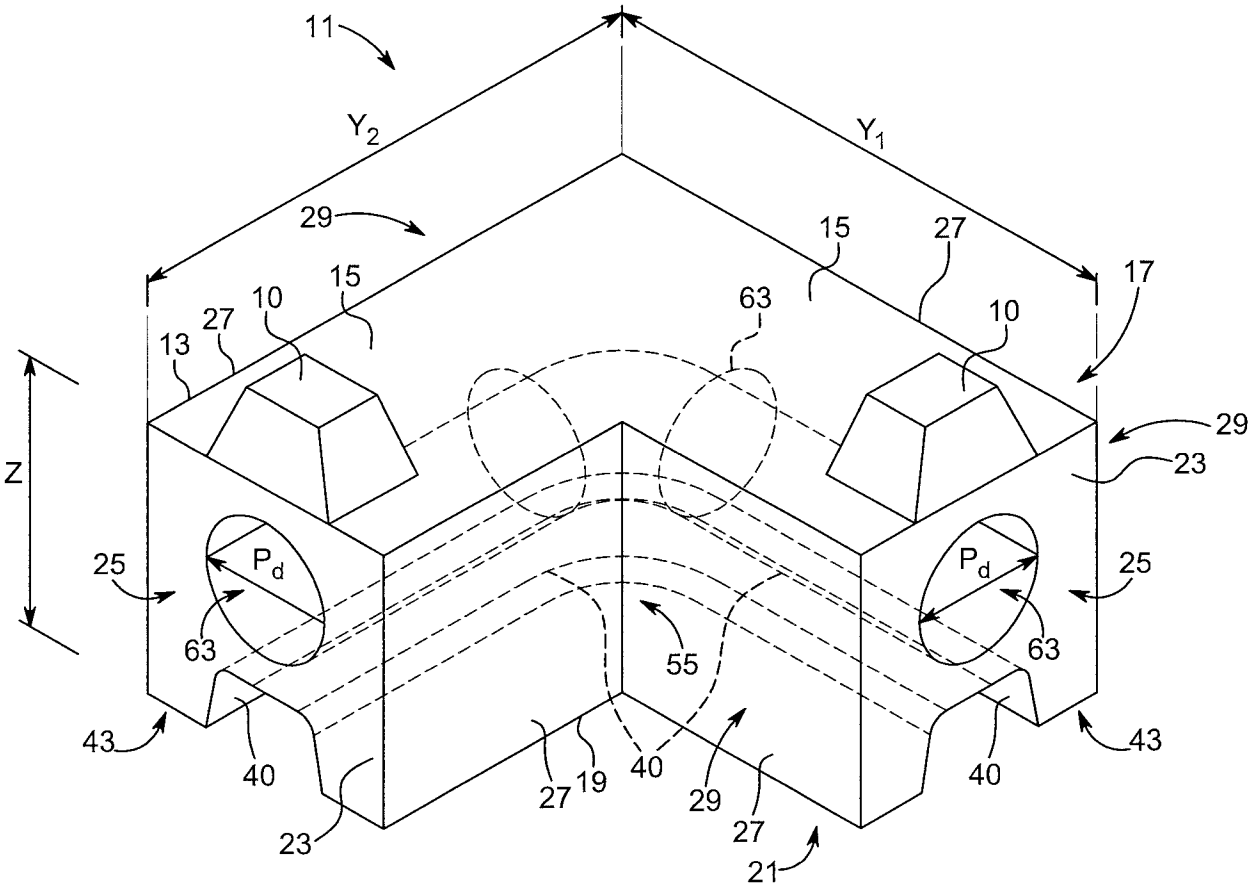
FIG. 9C is a perspective view of a corner block according to various embodiments described herein.
Figure 9D:
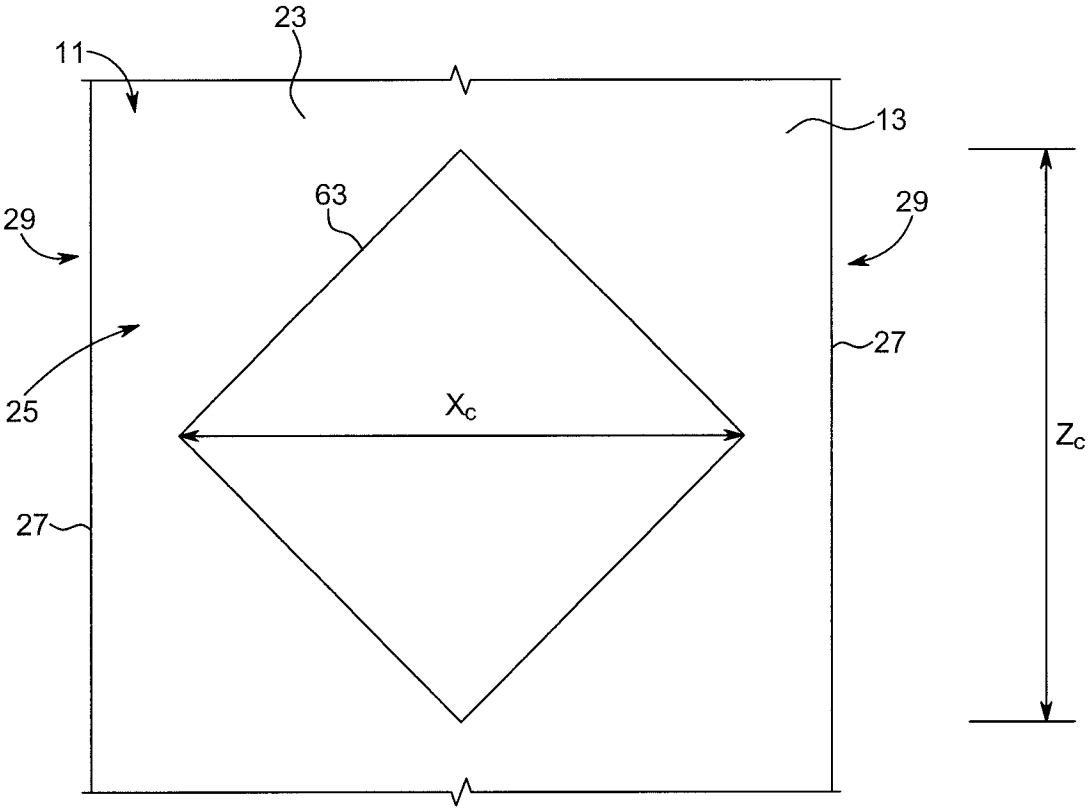
FIG. 9D illustrates a passageway according to various embodiments described herein.
Figure 10:
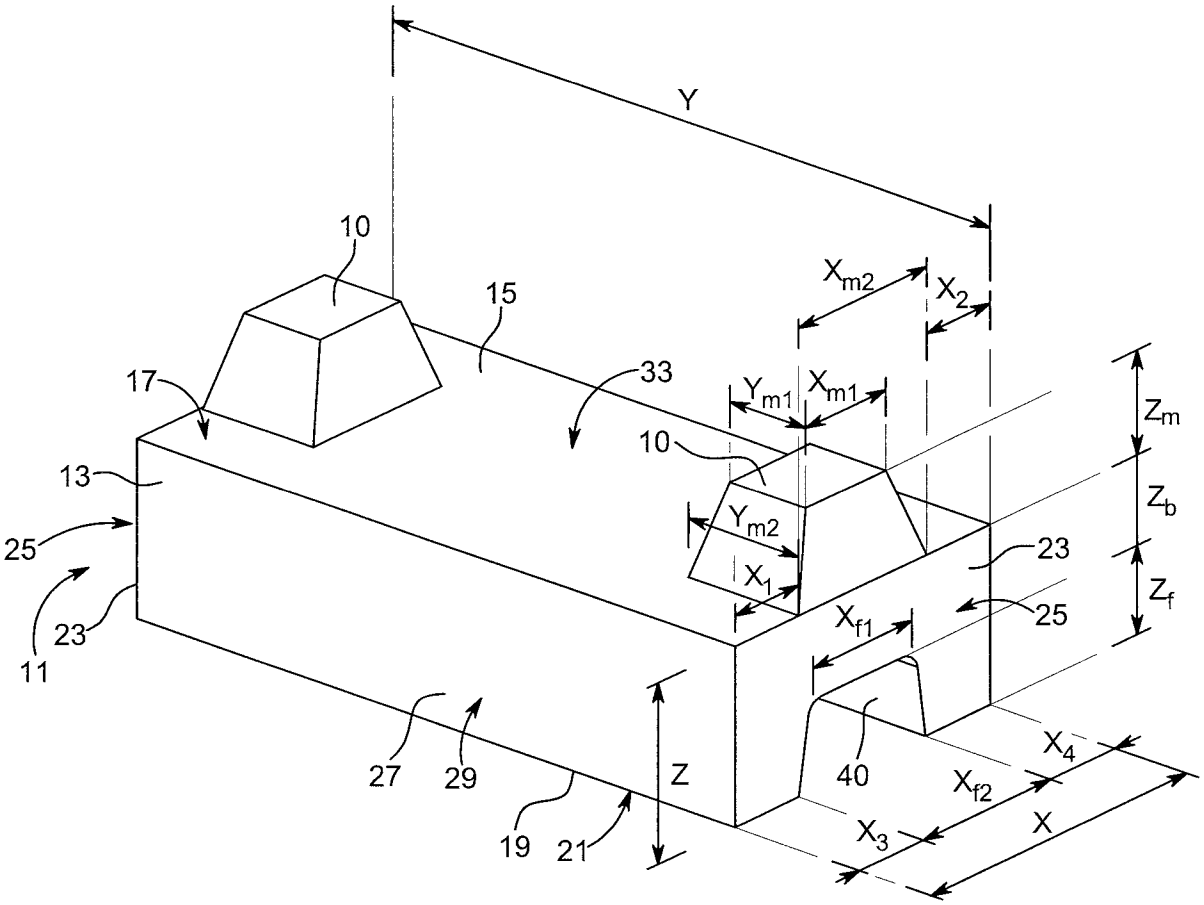
FIG. 10 is a perspective view of a solid half block according to various embodiments described herein.
Figure 11:
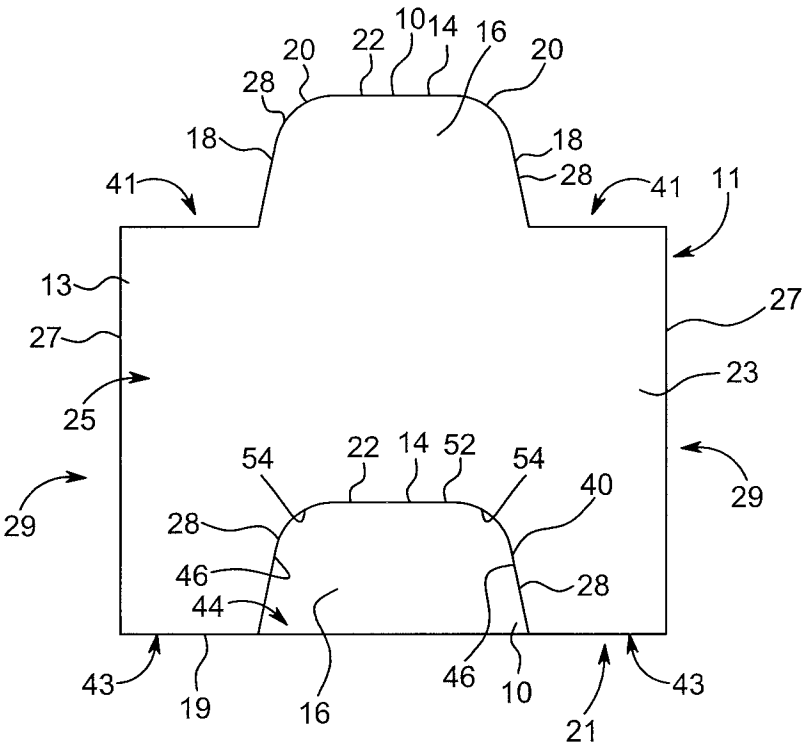
FIG. 11 is a side view of a block having a female fitting interlockingly mated with a male fitting according to various embodiments described herein.

FIGS. 6-10 illustrate column blocks 11 comprising prism shaped key and keyway fittings according to various embodiments. The blocks 11 may be configured for column applications. For example, in various embodiments, the column blocks 11 may allow reduction of weight bearing columns that may be otherwise required. For example, in one embodiment, where a vertical column may be otherwise required every four feet, column blocks 11 according to the present disclosure may be configured to eliminate one or two such columns in a twelve foot span utilizing, for example, a lally type column in conjunction with the column blocks 11 in the twelve foot span. Thus, the column blocks 11 may eliminate block cutting and waste and provide a cocoon for a steel or otherwise reinforced column. In various embodiments, similarly configured column blocks 11 may also be used for door and window casing frames. Window sills and headers may, for example, be poured in place with utilization of tie beam blocks 11, e.g., as shown in FIG. 11.

The blocks 11 include a block body 13 having a vertical length Z extending between an upper face 15 positioned at an upper end 17 and a lower face 19 positioned at a lower end 21. The block body 13 may also include a longitudinal length Y extending between longitudinal faces 23 positioned at longitudinal ends 25 and a lateral length X extending between lateral faces 27 positioned at lateral ends 29. The blocks 11 may further include one or more male fittings 10 or one or more female fittings 40, which may be dimensioned similar to those described above with respect to FIGS. 1-5, however, for clarity and brevity, the particulars of various dimensions may not be repeated in detail.

In various embodiments, the blocks 11 may include a hollow core portion comprising a vertical passageway 31, for example, as depicted in FIGS. 6-9. The vertical passageway 31 may be dimensioned to receive a reinforcement material or structure such as a beam or column. In other embodiments, however, blocks 11 may include a solid core 33, for example, as shown in FIG. 10. The vertical passageway 31 may include a longitudinal length $Y_c$ defined between longitudinal walls 35 and a lateral length $X_c$ defined between lateral walls 37, which may be coupled between arcuate rounded edges 39 or, in at least one embodiment, straight edges (not shown).

Each block 11 may include one or more male fittings 10 or one or more female fittings 40 dimensioned. As depicted in FIGS. 6-10, each block 11 includes two male fittings 10 positioned at the upper end 17 of the block 11 on the upper block face 15. The longitudinal and lateral lower edges 24, 26 are shown substantially flush with the upper face 15 and the upper base 14 may extend substantially parallel to the upper face 15. The male fittings 10 may be positioned such that the outwardly positioned longitudinal lower edge 26 with respect to the adjacent longitudinal end 25 of the block body 13 is aligned with the adjacent longitudinal face 23 of the block body 13. The inwardly positioned longitudinal lower edge 26 of the male fitting 10 may be vertically aligned with the adjacent longitudinal face 35 of the vertical passageway 31. In at least one embodiment, however, the position of the male fitting 10 may be inwardly offset with respect to the adjacent longitudinal face 35. The male fitting 10 may also be laterally positioned equidistant from the lateral faces 27 of the block body 13 such that a distance $X_1$, $X_2$ between each lateral lower edge 24 of the male fitting 10 and the adjacent lateral face 27 of the block body 13 is substantially the same. The lower lateral edges 24 may also align substantially parallel with the lateral face 27. In at least one embodiment, however, the male fitting 10 is laterally offset and the distances $X_1$, $X_2$ between each lateral lower edge 24 of the male fitting 10 and the adjacent lateral face 27 of the block body 13 are different. In at least one embodiment, one or both lateral lower edges 24 may be positioned such that the lateral lower edges 24 are vertically aligned with the lateral face 27 of the block body 13. As show, the male fittings 10 include similar dimensions, however, in at least one embodiment, a block 11 may include two male fittings 10 having different dimensions.

The female fittings 40 may be defined in the lower face 19 at the lower end 21 of the block body 13 such that a distance $X_b$ between the upper base 42 and the upper face 15 of the block body and the height of the female fitting $X_f$ corresponds to the vertical length Z of the block body between the upper and lower faces 15, 19. The upper base 42 of the female fitting 40 may be aligned substantially parallel with the lower face 19 of the block body 13. When two blocks 11 are mated, the opposed faces 15, 19 of the block bodies 13 may engage along lateral regions 41, 43. For example, the lateral region 41 of the upper face 15 may be configured to abut the lateral region 43 of the lower face 19 of an opposed block 11 when the respective male fitting 10 and female fitting 40 are mated. The female fitting 40 may also be laterally positioned equidistant from the lateral faces 27 of the block body 13 such that a distance $X_3$, $X_4$ between each lower edge 56 of the female fitting 40 and the adjacent lateral face 27 of the block body 13 is substantially the same. The lower edges 26 may also align substantially parallel with the lateral faced 27. In at least one embodiment, however, the female fitting 40 is laterally offset and the distances $X_3$, $X_4$ between each lower edge 56 of the female fitting 40 and the adjacent lateral face 27 of the block body 13 are different.

Figure 6:
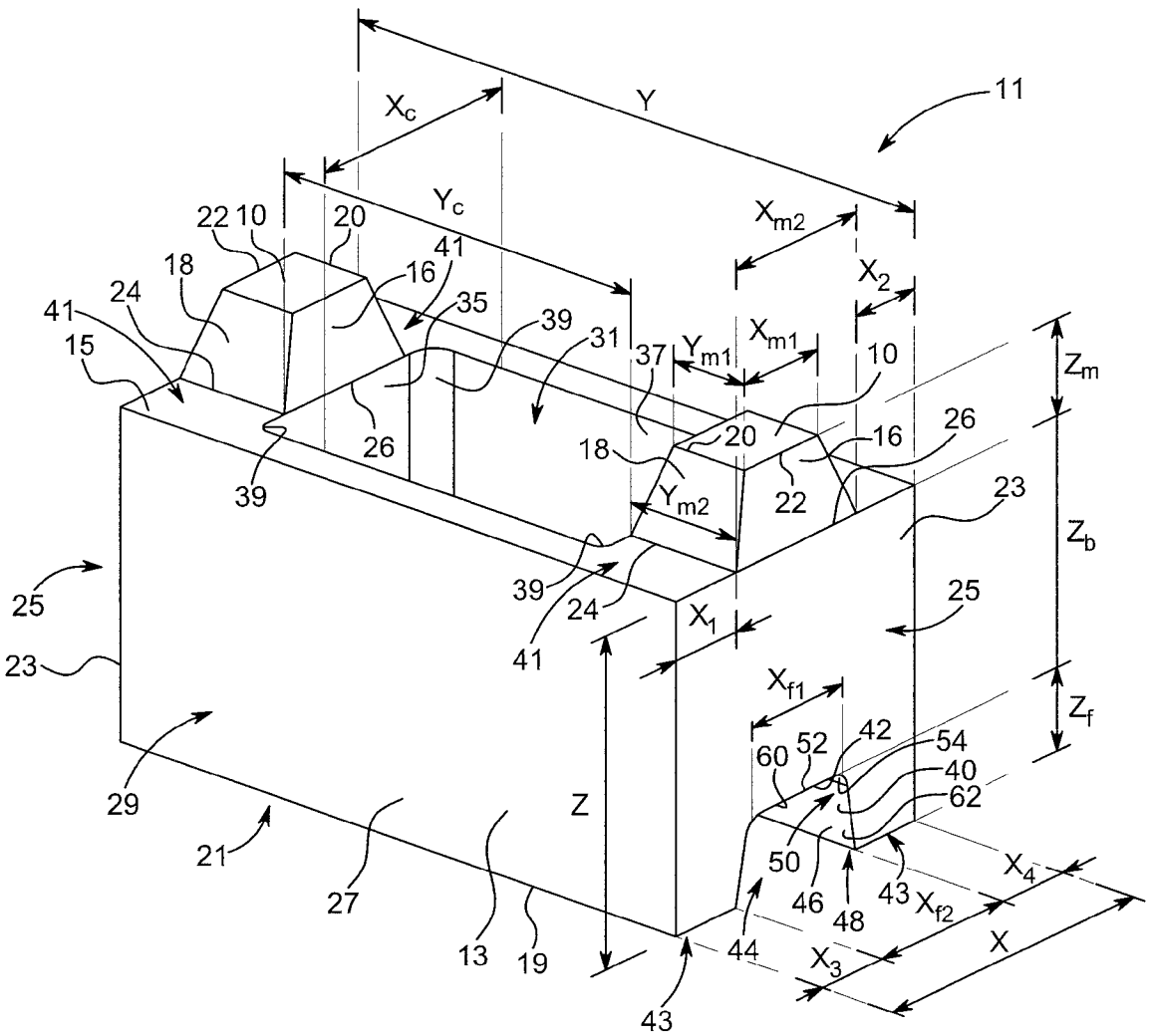
FIG. 6 is a perspective view of a column block according to various embodiments described herein.
Figure 7:
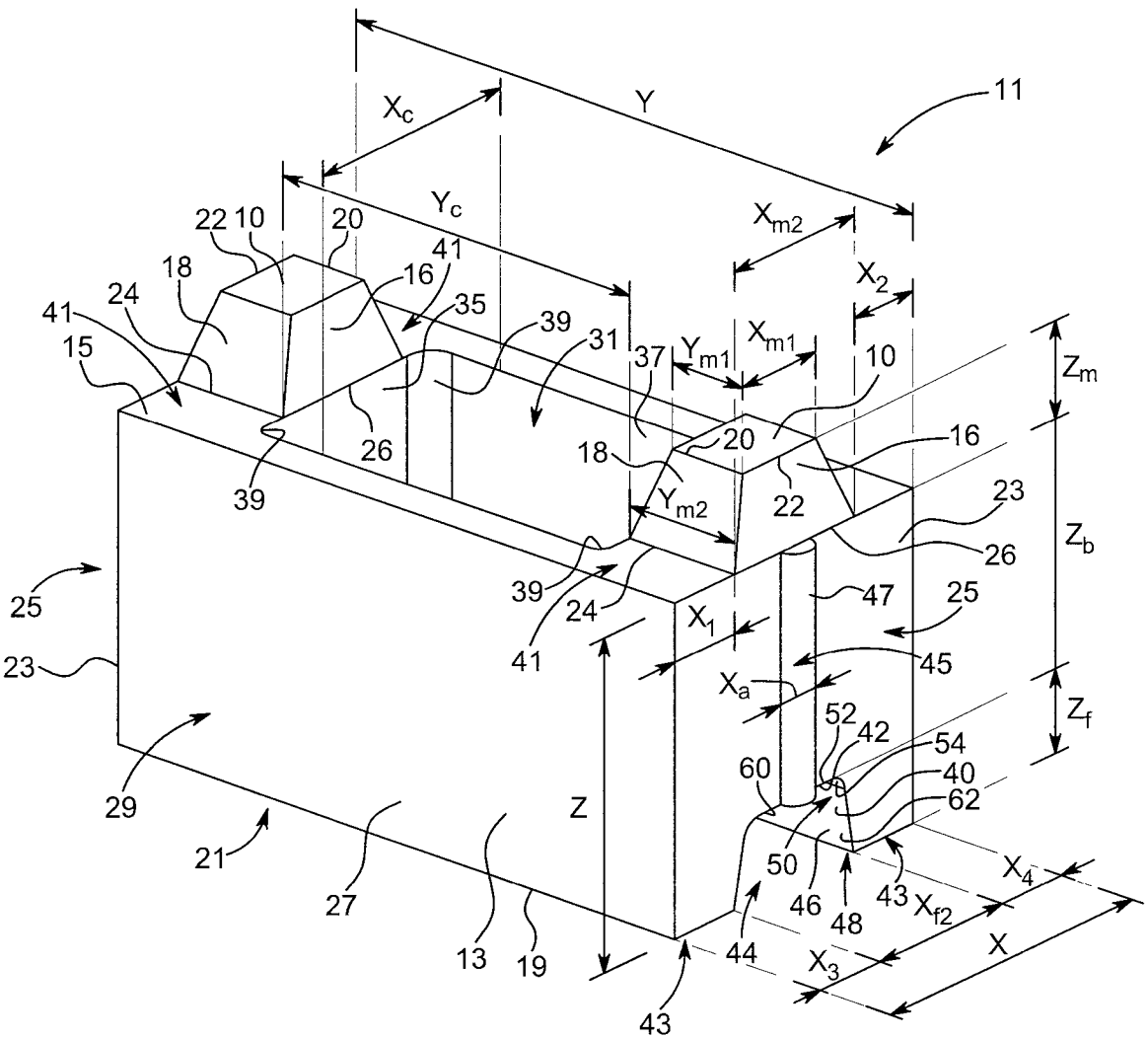
FIG. 7 is a perspective view of a column block according to various embodiments described herein.
Figure 8:
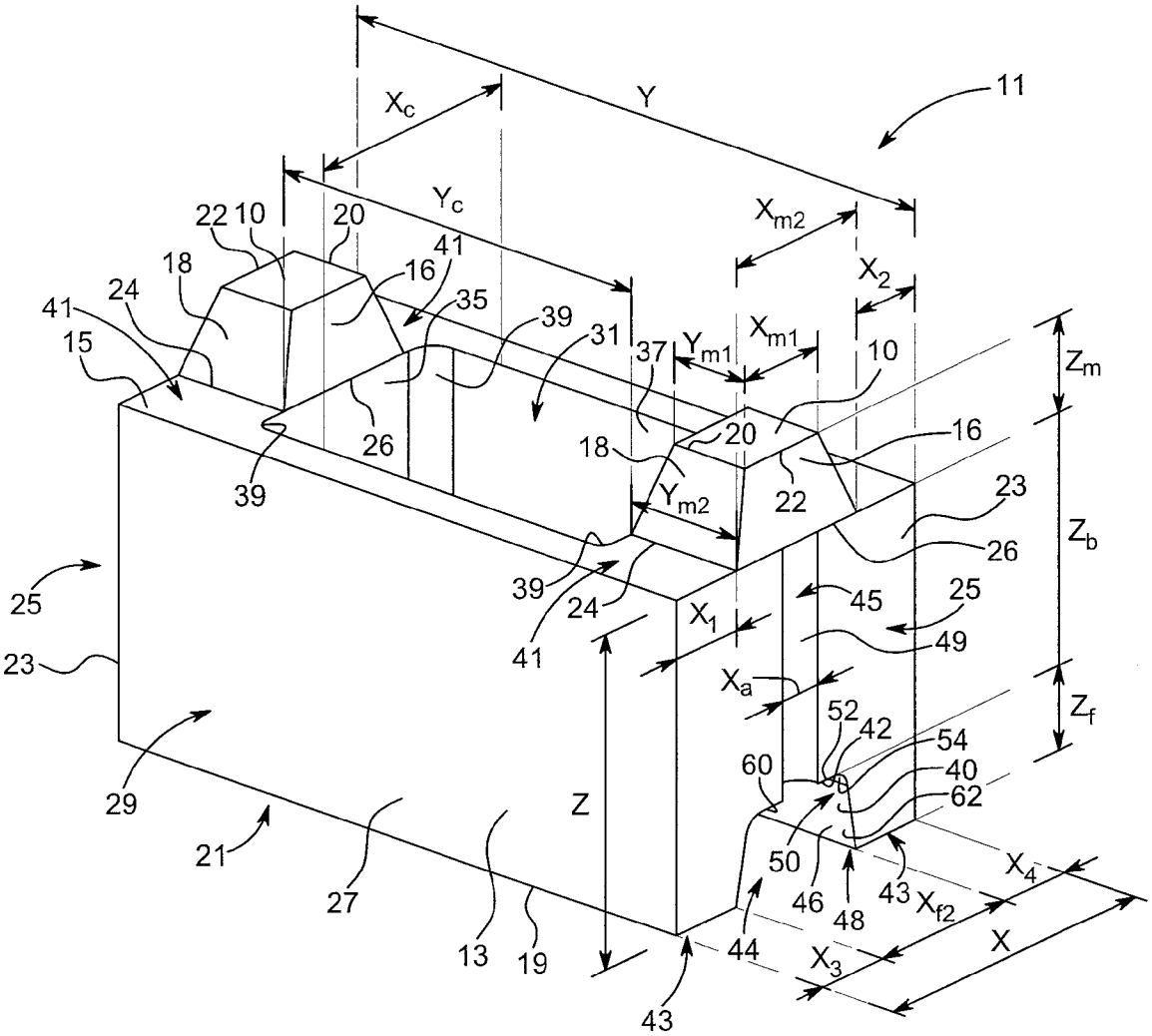
FIG. 8 is a perspective view of a column block according to various embodiments described herein.

FIG. 6 illustrates a column block 11 having flat longitudinal faces 23. FIGS. 7 & 8 illustrate column blocks 11 having arcuate side fittings 45 positioned on the longitudinal faces 23 of the blocks 11. The arcuate side fittings 45 may extend along length $Z_b$ between the male and female fittings 10, 40. FIG. 7 illustrates a male arcuate fitting 47 that extends along the longitudinal face 23 between the longitudinal lower edge 26 of the male fitting 10 and the longitudinal edge 52 of the female fitting 40. FIG. 8 illustrates a female arcuate fitting 49 that extends along the longitudinal face 23 of the block 11 between the longitudinal lower edge 26 of the male fitting 10 and the longitudinal edge 52 of the female fitting 40. The male and female arcuate fittings 47, 49 comprise complementary dimensions such that when the blocks 11 shown in FIGS. 7 & 8 are longitudinally aligned the male and female arcuate fittings 47, 49 are configured to mate about the opposed surfaces of the male and female arcuate fittings 47, 49. The lateral length $X_a$ of the arcuate fittings 47, 49 may extend within the lateral lengths of the male and female fittings 10, 40 and may be positioned equidistant from the side faces 27 of the respective block 11. In one example, for instance, the arcuate fittings 47, 49 may be equidistant from side faces 27 and comprise lateral lengths $X_a$ of about one inch. Blocks 11 comprising arcuate fittings 47, 49 may include a male arcuate fitting 47 at one or both longitudinal faces 23, a female arcuate fitting 49 at one or both longitudinal faces 23, or a male arcuate fitting 47 at one longitudinal face 23 and a female arcuate fitting 49 at the other longitudinal face 23. In certain configurations, mating of arcuate fittings 47, 49 may further increase the strength of a structural unit with respect to withstanding shifting, shear, impacts, or other events that may compromise the structure.

While not shown, in one embodiment a block 11 includes upper and lower male fittings 10 configured for semi-interlocking interaction with blocks 11 having female fittings 40 at adjacent faces. Similarly, blocks 11 may include upper and lower female fittings 40. In one embodiment, a block 11 is subdivided such that it includes an upper male 10 and upper female fitting 40 configured for semi-interlocking engagement with a block 11 having a lower male fitting 10 or lower female fitting 40. The block 11 may also include a lower male fitting 10, a lower female fitting 40, or both. Although not show, in at least one embodiment, mateable blocks may include a first block 11 including only one or more male fittings 10, which may be positioned at one end or multiple ends, and a second block 11 that includes only one or more female fittings 40, which may be configured to receive one of the one or more male fittings 10.

In an illustrative example of various non-limiting dimensions of a column block 11 configured according to various embodiments of blocks 11 described above, e.g., in FIG. 6-8, the block body 13 may include a vertical length Z and lateral length X of about eight inches and a longitudinal length Y of about sixteen inches. The vertical passageway 31 may include a lateral length $X_c$ of about six inches and a longitudinal length $Y_c$ of about ten inches. Thus, the thickness of lateral face 27 extending between the longitudinal ends 25 of the block 11 may be about one inch or about one eighth the width of the corresponding portion of the block body 13. The lower base 12 of the male fitting 10 may be configured to be complementary to that of the entrance of the female fitting 40 along the lower face 19 of the block 11 such that the lateral side faces 18 abut the side faces 46 just adjacent to the lower face 19 of the block 11.

FIG. 9A illustrates a corner column block 11 according to various embodiments. Each lateral face 27 of the block body 13 includes a corner 51 having an outer corner 53 and inner corner 55. While the corner 51 shown in FIG. 9A is a 90° corner, it will be appreciated, however, that corners 51 having different angles may be used. Additionally, lengths between the outer corner 53 and the longitudinal faces 23 may be the same or different as needed. Similarly, lengths between the inner corner 55 and the longitudinal faces 23 may be the same or different as needed. In one embodiment, corner blocks 11 are configured with lateral faces 27 adjacent to the outer corner 53 having different lengths $Y_1$, $Y_2$, e.g., a full length $Y_1$ face 27 along one side of the corner 53 and a half length $Y_2$ face 27 along the adjacent side of the outside corner 53, which may provide staggering of interfaced blocks 11 when used in conjunction with additional corner blocks 11 having lateral faces 27 of different lengths adjacent to the outer corner 53. As shown, the lengths $Y_1$, $Y_2$ of the lateral faces 27 are substantially the same between the outer corner 53 and longitudinal faces 23 and between the inner corner 55 and longitudinal faces 23. Within the vertical passageway 31, lengths $Y_{c1}$, $Y_{c2}$ between the lateral walls 37 adjacent to the outer corner 53 and respective longitudinal walls 35 of the vertical passageway 31 may be the same or different as needed. As shown, the lengths $Y_{c1}$, $Y_{c2}$ are substantially the same between the outer corner 33 within the vertical passageway 31 and each longitudinal wall 35 and between the inner corner 35 within the vertical passageway 31 and each longitudinal wall 35. As in the above embodiments, the vertical passageway 31 may include arcuate edges 39 along the walls 35, 37.

In one illustrative example, the corner block 11 may have dimensions including lengths $Y_1$, $Y_2$ along the lateral faces 27 adjacent to the outer corner 53 of about sixteen inches and about eight inches along the lateral faces 27 adjacent to each inner corner 55. The length X along the longitudinal faces 25 and the length Z may be about eight inches. However, other dimensions may be used. For example, the height, width, length may be increased or decreased, e.g., by eighths, quarters, halves, multiples, etc. The lengths $Y_{c1}$, $Y_{c2}$ of the vertical passageway 31 may be about twelve inches and the length $X_c$ between the lateral walls 37 of the vertical passageway 31 may be about six inches.

In various embodiments, the system may include blocks 11 having dimensions configured to support accessory features, such as a hollow core portion comprising a passageway 63 defined through the block body 13 as shown in FIGS. 9B-9D. Accessory features may include, for example, insulation, cabling, piping, deodorizers or even structural supporting materials. Such passageways 63 may comprise a horizontal opening or thoroughfare extending within the block 11. In some embodiments, blocks 11 may include a hollow core portion comprising one or more passageways 63 extending laterally through the block 11. In at least one embodiment, a block 11 includes a hollow core portion comprising both horizontal and lateral extending passageways 63.

The passageways 63 shown in FIGS. 9B & 9C define arcuate passages, however, other dimensions may be used including regular, irregular, geometric, or non-geometric shapes or cross sections. For example, in one embodiment, the passageway 63 may define a rectangular cross-section, as depicted in FIG. 9D, or a circular, oval, or diamond shaped opening or passage. The passageway 63 illustrated in FIG. 9D is oriented with respect to the block 11 such that it includes a vertical length $V_c$ and a lateral length $X_c$. The position and dimensions of the passageway 63 may be configured such that load may be distributed through the block without significantly affecting the soundness of the block with respect to the engineering standards applicable to the application. The passageway 63 may include rounded or straight edges within the block 11 or along the interface with the longitudinal faces 23 of the block 11. For example, the passageway 63 depicted in FIG. 9D includes edges that are quarter rounded. The passageway 63 may be configured to allow for expansion or contraction of the block 11 to be confined to the inner core of the block 11. This may combine with the structural benefits of the rounded dimensions or edges of the fittings 10, 40 above and below the passageway 63 or core disabling movement of mortar or adhesive at the outer surfaces of the block 11.

The passageways 63 of the blocks 11 shown in FIGS. 9B & 9C define a diameter $P_d$ and are positioned equidistant from the respective upper face 15 of each block body 13 and the upper base 42 of the female fitting 40. The passageways 63 may also be laterally positioned equidistant between lateral side faces 18 of the male fitting 10 and the lower base opening 44 of the female fitting 40. The block 11 illustrated in FIG. 9C differs from the blocks illustrated in FIGS. 6-9B in that the configuration of FIG. 9C does not include a vertical passageway 31. The passageway 63 extends longitudinally through the block 11 between the longitudinal ends 25. The female fitting 40 may also extend between the longitudinal ends 25 of the block 11. At the corner of the block 11, the female fitting 40 may extend in a rounded manner such that an arcuate edge is formed along the corner. In other embodiments, the female fitting 40 may extend between the longitudinal ends 25 of the block to form a straight edge corner at the corner of the block 11. In at least one embodiment, the features of the blocks 11 illustrated in FIGS. 9B & 9C corresponding with those of FIG. 9A may include similar dimensions to those described above with respect to the non-limiting example of FIG. 9A. In one such embodiment, the diameter $P_d$ of the passageway 63 of the blocks 11 illustrated in FIGS. 9B & 9C may be about four inches.

In further embodiments, the blocks 11 illustrated in FIGS. 6-9C may be configured to include one or more reduced dimensions, e.g., reduced heights, lengths, or widths. For example, the block 11 illustrated in FIG. 10 includes a reduced vertical dimension and may comprise a half block with respect to the vertical length Z, for example, when compared to the block 11 shown in FIG. 6. However, the vertical lengths $Z_m$, $Z_f$ of the male fitting 10 and female fitting 40 may remain the same despite the reduction in height or other dimension. In this embodiment, the vertical length $Z_m$ of the male fitting 10 is substantially the same as the vertical length $Z_f$ of the female fitting 40 and the vertical length $Z_b$ of the block body 13 between the male fitting 10 and female fitting 40 is substantially the same as lengths $Z_m$ and $Z_f$. In at least one embodiment, length $Z_b$ of the block body 13 between the male fitting 10 and the female fitting 40 is greater than or equal to lengths $Z_m$ and $Z_f$.

FIG. 10 illustrates a block 11 having a solid core 33. The solid core 33 may cap, protect, or seal a core assembly defined through stacked column blocks 11 or increase structural integrity. In various embodiments, the blocks 11 illustrated in FIGS. 6-9C may similarly be configured with solid cores 33. Blocks 11 that include a solid core 33 may also include one or more male fittings 10 or female fittings 40 positioned along the solid core 33. For example, a male fitting 10 or female fitting 40 may extend the longitudinal length Y of the block 11 or three or more male fittings 10 or female fittings 40 may be positioned therealong.

FIG. 11 illustrates a locking engagement mating of male and female fittings 10, 40. In this embodiment, the male and female fittings 10, 40 are complementary such that the fittings engage along the upper bases 14, 42, lateral upper edges 22, 54 (which may be arcuate) and along upper ends 30, 50 and lower ends 32, 48 of the side faces 18, 46. In various embodiments, the block system may include block configurations with fittings complementary to a block that may otherwise be configured for semi-interlocking interaction with additional system blocks.

Figure 12:
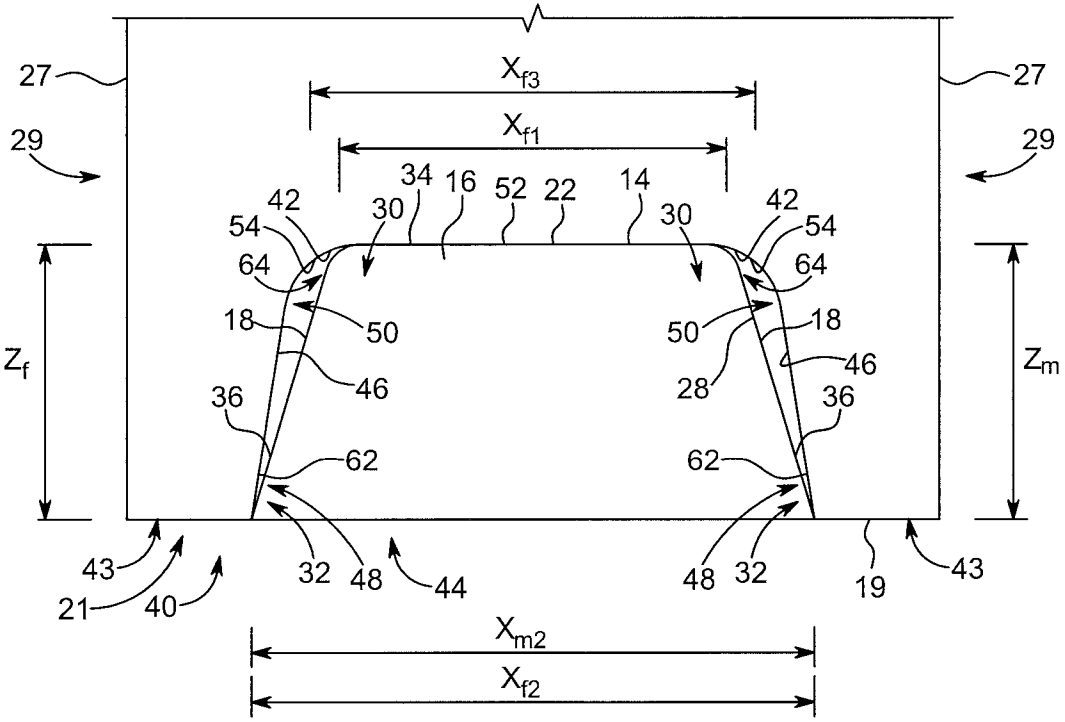
FIG. 12 is a side view of a block having a female fitting semi-interlockingly mated with a male fitting according to various embodiments described herein.

FIG. 12 illustrates a semi-interlocking mating between a male fitting 10 and female fittings 40. The engagement surfaces 34, 60 of the upper bases 14, 42 abut and the engagement surfaces 36, 62 along the lower ends 32 of the lateral side faces 18 and the side faces 46. The male fitting 10 and female fitting 40 may be configured for semi-interlocking interaction such that longitudinally extending gaps 64 are defined between the lateral side faces 18 and side faces 46, similar to FIG. 4. Laterally extending gaps 66 may also be formed along the longitudinal side faces 16 of the male fitting 10, similar to FIG. 5. In another or further embodiment, the block system may include male fittings 10 or female fittings 40 configured for interlocking engagement with a mated fitting and thus may include a male fitting 10 or female fitting 40 having dimensions corresponding to an intended opposed fitting. For example, a block 11 may include a male fitting 10 having dimensions including arcuate lateral upper edges 20 and lateral side faces 18 configured to engage the side faces 46 of a female fitting 40.

In one illustrative example block dimensions providing semi-interlocking interaction, e.g., in blocks 11 configured according to FIGS. 6-10, and with reference to FIG. 12, the longitudinal lower edge 26 of the male fitting 10 and the lower base opening 44 of the female fitting 40 may comprise a length $X_{m2}$, $X_{f2}$ of about four inches. The lateral lower edges 24 of the male fitting 10 may comprise a length $Y_{m2}$ about 3 inches. The lengths $X_1$, $X_2$, $X_3$, $X_4$ between the lateral lower edges 24 of the male fitting 10 and the lower edges 56 of the female fitting 40 may be about two inches from the adjacent lateral face 27 such that the lateral portions 41, 43 of the block body 13 extend laterally about two inches outward of the about four inch length $X_{m2}$ of the longitudinal lower edge 26 of the male fitting 10. The upper base 14 may have length $Y_{m1}$ of about two inches and length $X_{m1}$ of the about two and one half inches. The lateral length $X_{f1}$ along the longitudinal edge 52 of upper base 42 of the female fitting 40 may be about three and one eighth inches taken between midpoints of the arcuate edges 54. The arcuate edges 54 may extend between the upper base 42 and side faces 46 of the female fitting 40 and may comprise quarter rounded arcs having about a one half inch radius. The lateral length $X_{f3}$ of the upper base 42 of the female fitting 40 and the arcuate edges 54 taken from lower feet of the edges 54 may be about three and one half inches.

In another example, a block 11 having a reduced vertical dimension, such as the block 11 shown in FIG. 10, may have a block body 13 having a vertical height Z of about four inches between the lower face 19 and the upper face 15. Thus, according to various embodiments, the dimensions of the block body 13 may be altered to purpose blocks 11 for particular applications with respect to the block system and be configured to form structural units while maintaining the dimensions of the male fitting 10 and female fitting 40. In some embodiments, one or more blocks 11 configured according to FIGS. 6-9D may include reduced vertical dimensions similar to the configuration shown in FIG. 10.

Those having skill in the art will appreciate upon reading the present disclosure, however, that certain dimensions or ratios of dimensions may be altered while still obtaining the beneficial features described herein. For example, one or more dimensions may be scaled up or down without departing from the present disclosure. Ratios of dimensions may also be increased or decreased.

FIGS. 13A-13E illustrate blocks 11 having a tie-beam configuration. In various embodiments, the tie-beam blocks 11 may be configured to eliminate plywood forms, "C" clamp, "H" clamps, snap ties and whalers, etc. that may otherwise increase time, cost, and labor and are material intensive. The blocks 11 may include extensions 71 extending from the upper face 15 of the block body. The extensions may align with the lateral faces 27 of the block 11 and form a slot 57 at the upper end 17 of the block 11 configured to receive a beam. The block 11 may further include a female fitting 40 defined in the lower face 19. The female fitting 40 may extend the longitudinal length Y of the block 11 or along portions corresponding to male fittings 10 of blocks 11 to which the block 11 may be mated. The blocks 11 illustrated in FIGS. 13A, 13D, and 13E include a vertical passageway 31 formed through the block 11 between the lower end 19 and upper end 17 positioned at a base 59 of the slot 57. The block 11 illustrated in FIG. 13D further includes multiple passageways 31*a*, 31*b* formed through the block 11 between the lower end 19 and the upper end 17 positioned at the base 59 of the slot 57. In contrast, the blocks 11 illustrated in FIGS. 13B and 13C include solid cores 33 and the base 59 of the slot 57 extends continuously between the ends 25.

The tie-beam blocks 11 may be configured in a variety of dimensions including configurations having an increased or reduced vertical height, longitudinal length, or width. The example blocks 11 shown in FIGS. 13A-13D include various combinations of features such as cores 33 and passageways 31 as well as relative dimensions such as vertical, lateral, and longitudinal dimensions of the block 11, passageways 31, slots 57, and block body 13. As such, it is to be understood that these combinations are intended to be examples of combinations of features and dimensions and that other combinations of such features and dimensions may used. The tie-beam block 11 illustrated in FIG. 13E may include block dimensions similar to those described above for corner blocks 11 illustrated in FIGS. 9A-9C. The block 11 illustrated in FIG. 13A includes a longitudinal length Y that is increased with respect to the longitudinal length Y of the block illustrated in FIG. 13B. In one illustrative example, the longitudinal length Y of the blocks 11 illustrated in FIGS. 13A, 13C, and 13D and the lengths $Y_1$ and $Y_2$ of the corner block 11 illustrated in FIG. 13E may be about sixteen inches, while the longitudinal length Y of the block 11 illustrated in FIG. 13B may be about eight inches.

Figure 13A:
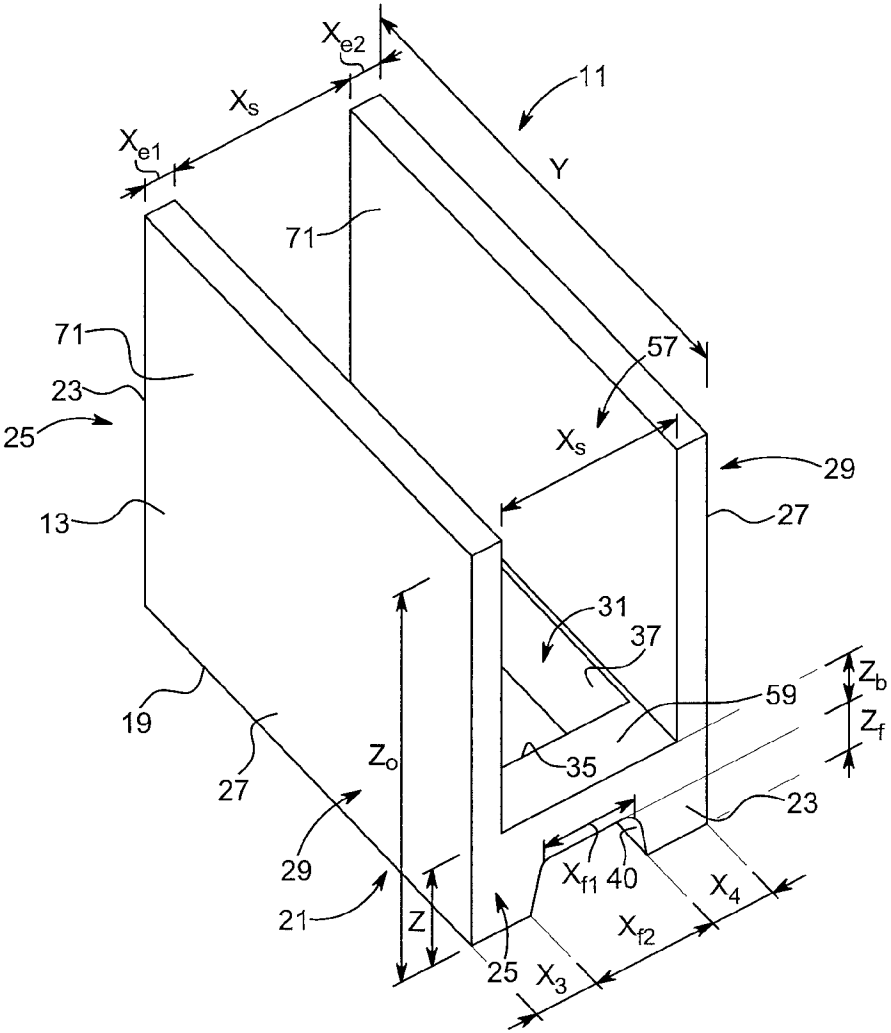
FIG. 13A is a perspective view of a tie-beam block according to various embodiments described herein.
Figure 13B:
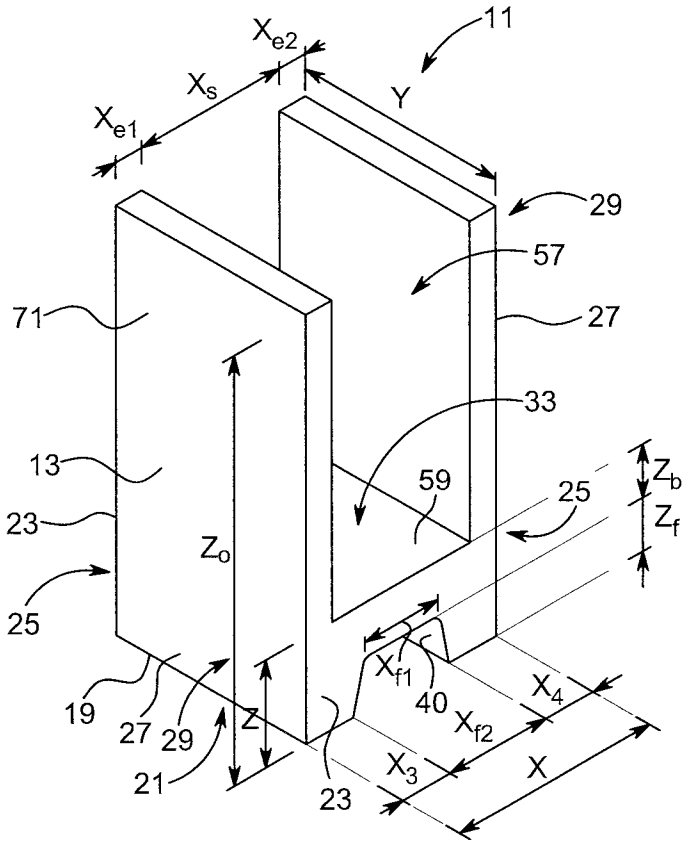
FIG. 13B is a perspective view of a tie-beam block according to various embodiments described herein.
Figure 13C:
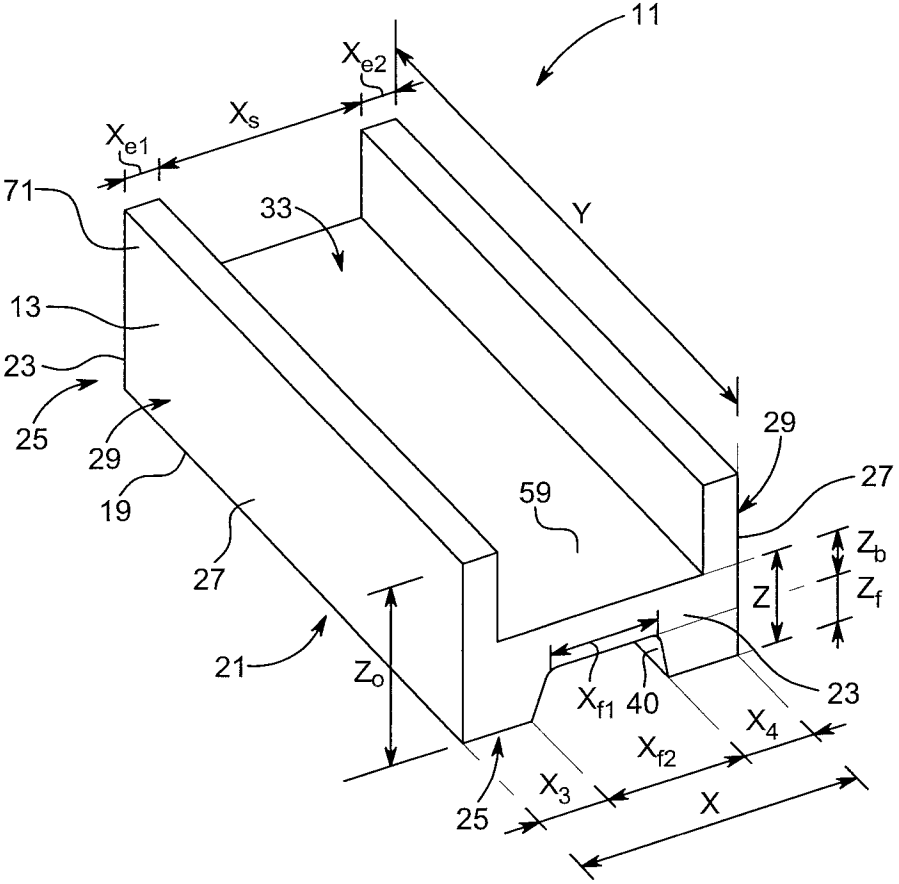
FIG. 13C is a perspective view of a tie-beam half block according to various embodiments described herein.
Figure 13D:
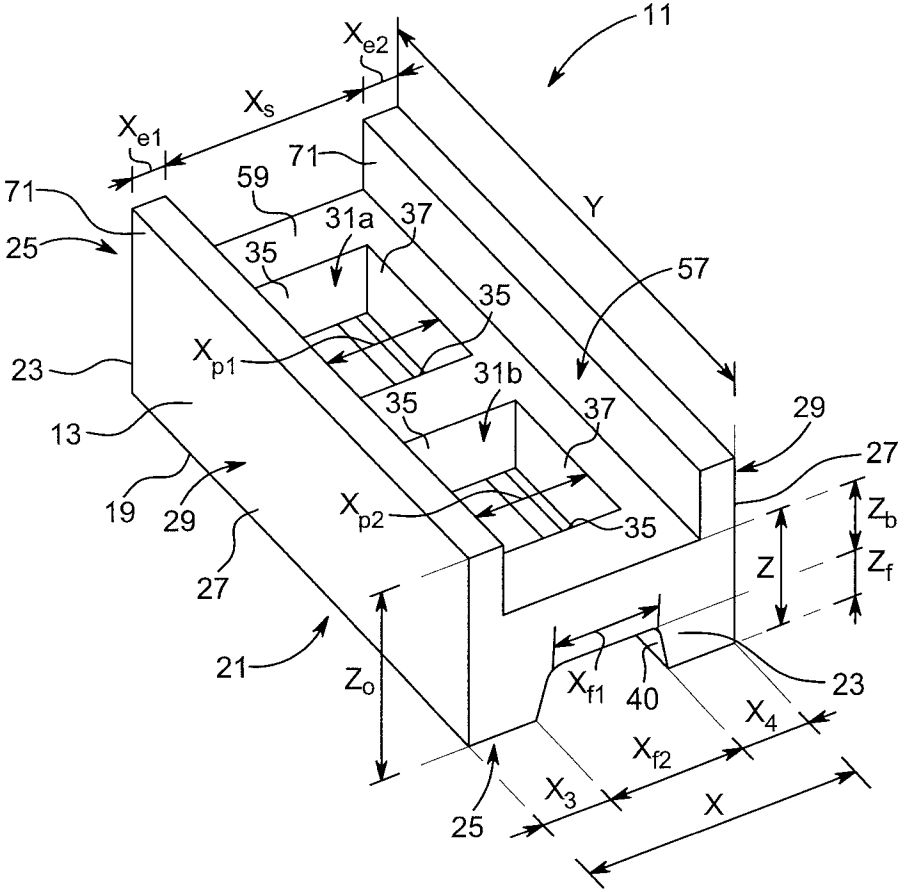
FIG. 13D is a perspective view of a tie-beam half block according to various embodiments described herein.
Figure 13E:
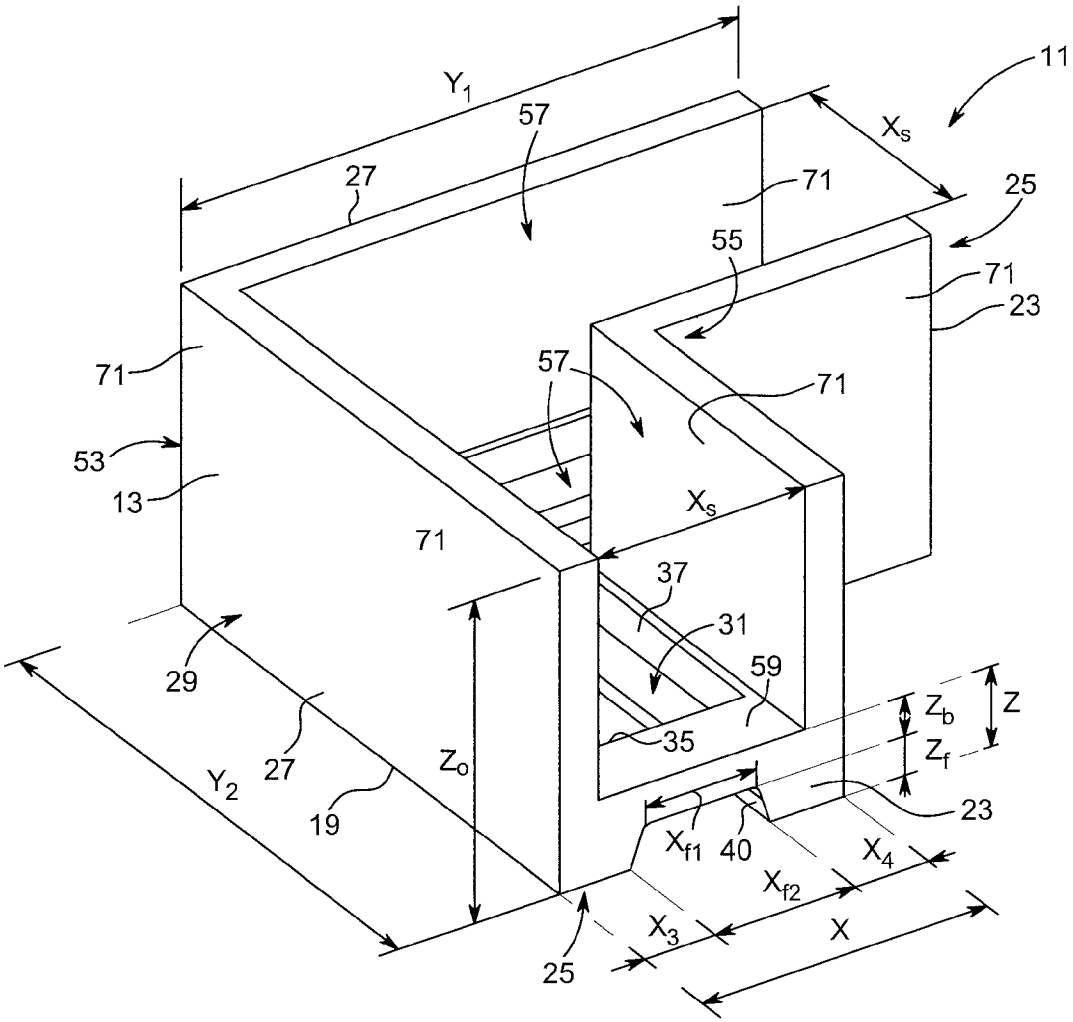
FIG. 13E is a perspective view of a tie-beam corner block according to various embodiments described herein.

The blocks illustrated in FIGS. 13B-13D may comprise half block configurations. In various embodiments, the vertical heights Z of the block bodies in FIGS. 13A-13E may be between about three and about six or between four and about five inches. For example, the vertical length Z of the block body 13 of the blocks illustrated in FIGS. 13A-13C and 13E may be about four inches and the vertical length Z of the block body 12 of the block 11 illustrated in FIG. 13D may be about five inches. The blocks 11 illustrated in FIGS. 13A, 13B, and 13E may comprise full block configurations with respect to the overall vertical height $Z_o$, including the tie portion of the lateral face 27, which may be about sixteen inches. The blocks 11 illustrated in FIGS. 13C and 13D may comprise half block configurations with respect to the overall vertical height $Z_o$, including the tie portion of the lateral face 27, which may be about eight inches. In the above examples, the vertical height of the tie portion of the blocks 11 illustrated in FIGS. 13A, 13B, and 13E may be about twelve inches, the vertical height of the tie portion of the block 11 illustrated in FIG. 13C may be about four inches, and the vertical height of the tie portion of the block 11 illustrated in FIG. 13D may be about three inches. In the same or other embodiments, the lateral length X of the block body 13 may be about eight inches and the lateral length X of a base 59 of the slot 57 may be about six inches and the lateral lengths $X_{e1}$, $X_{e2}$ of the extensions 71 may be about one inch. The lateral length of the passageway 31 may be substantially the same, greater than, or less than the lateral length X. For example, the passageways 31 of the blocks 11 illustrated in FIGS. 13A and 13E are shown having lateral lengths $X_p$ greater than $X_{f2}$, e.g., about six inches, while the passageways 31*a*, 31*b* of block 11 illustrated in FIG. 13D have lateral lengths $X_{p1}$, $X_{p2}$ about the same as $X_{f2}$, e.g., about four inches. The female fitting 40 may be similar to the female fittings 40 described above with respect to FIGS. 2-12 and may be configured for interlocking or semi-interlocking interaction when mated with an appropriate male fitting 10.

Figure 14:
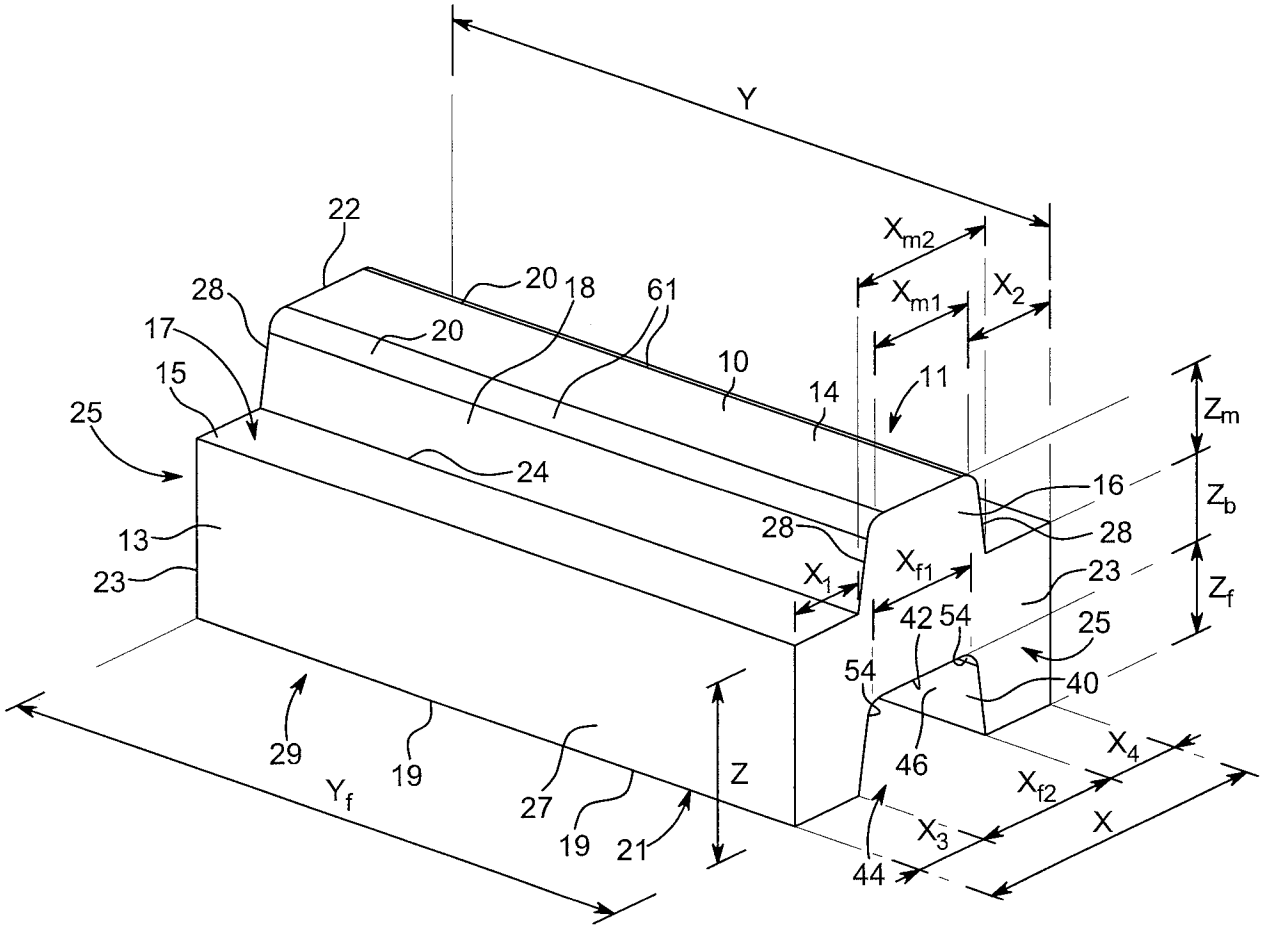
FIG. 14 is a perspective view of a key half block according to various embodiments described herein.

FIG. 14 illustrates a block 11 according to various embodiments. The block 11 may differ from those described with respect to FIGS. 6-12 in that the male fitting 10 extends the longitudinal length Y of the block body 13. The lateral side faces 18 of the male fitting 10 also define generally rectangular areas and include longitudinal side faces 16 aligned along the longitudinal faces 23 of the block body 13.

The lateral upper edges 20 connecting the lateral side faces 18 and upper base 14 of the male fitting 10 may also include arcuate edges 61. The arcuate edges 61 may extend about arcs having a radius similar or corresponding to the arcuate edges 54 of the female fitting 40. The male fitting 10 and female fitting 40 may be configured for interlocking or semi-interlocking interaction. As shown, the fittings 10, 40 are complementary such that the vertical lengths $Z_m$, $Z_f$, lateral lengths $X_{m1}$, $X_{f1}$ (taken between midpoints of respective arcuate edges 61, 54) and $X_{m2}$, $X_{f2}$, and the longitudinal length $Y_f$ of the female fitting 40 and the longitudinal length of the male fitting 10, which is substantially the same as the length Y of the block, are substantially the same. Thus, the block 11 configuration of FIG. 14 may thus be configured for interlocking interaction with fittings of like dimensions or for semi-interlocking interaction with appropriately dimensioned fittings of the block system.

In one non-limiting illustrative example of dimensions that may be used in a block 11 configured according to FIG. 14, the block body 13 may comprise a lateral length X of about sixteen inches, a vertical length Z of about four inches, and a longitudinal length Y of about eight inches. The vertical lengths $Z_m$, $Z_f$ of the respective male and female fittings 40 may be about two inches and the lateral length $X_{f2}$ of the lower base opening 44 of the female fitting 40 and the lateral length $X_{m2}$ between the lower ends 32 of the lateral side faces 18 at the lower longitudinal edge 26 of the male fitting 10 may be about four inches while the lateral lengths $X_{m1}$, $X_{f1}$ of the respective upper bases 14, 42 of the male fitting 10 and female fitting 40 may be about three inches, both with quarter rounded arcuate edges 61,54, which may define one half inch radii. As described above, blocks 11 may be provided having increased or reduced dimensions, e.g., the block shown in FIG. 14, and thus may include a half block, full block, etc. in a block system. For example, in a further illustrative example of a block system wherein vertical length Z may is four inches in a configuration dimensioned as a half block, vertical length Z may be eight inches in a configuration dimensioned as a full block. The male fitting and female fitting 40 may be positioned equidistant between adjacent lateral faces 27 of the block body 13.

Figure 15:
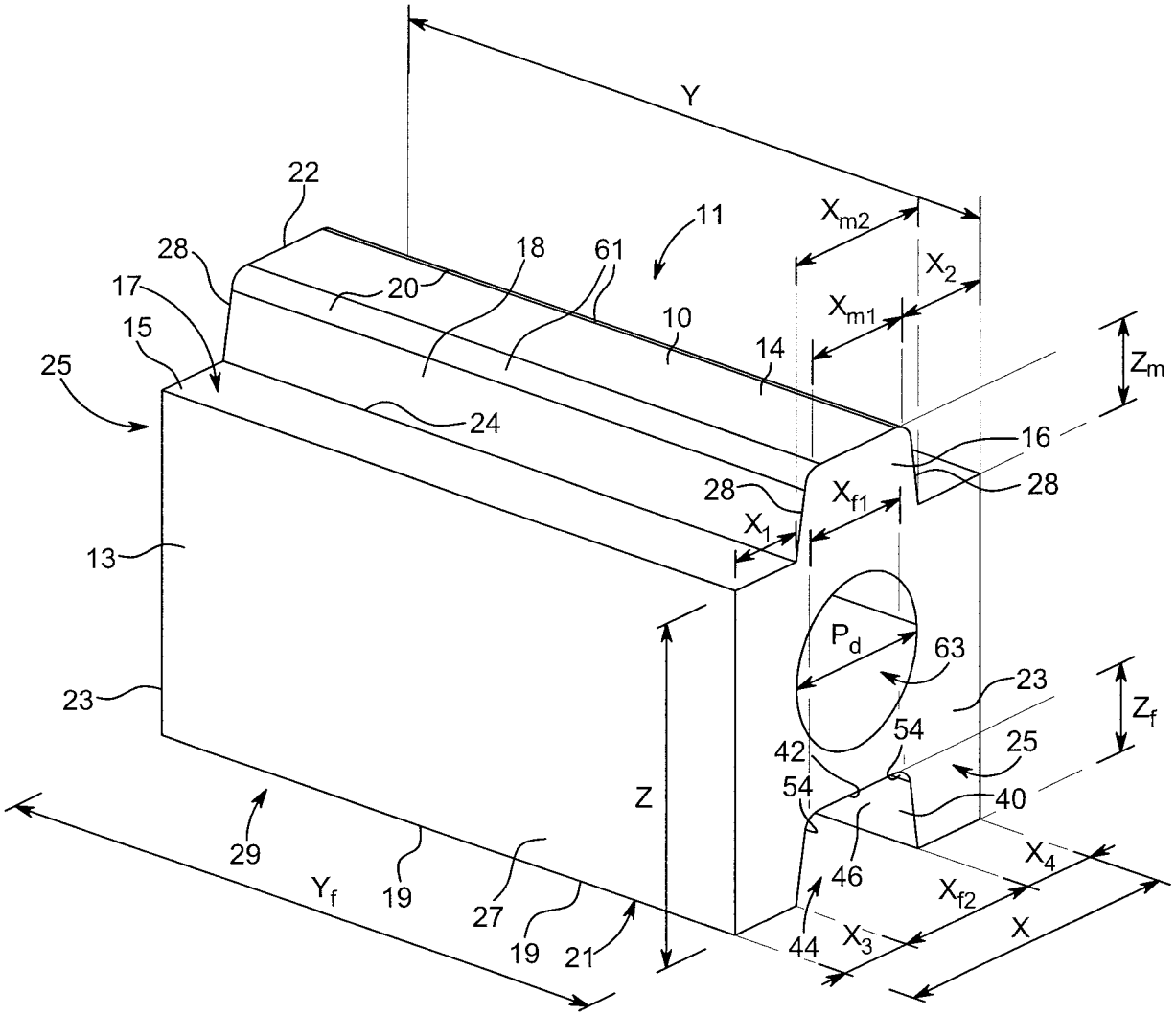
FIG. 15 is a perspective view of a block according to various embodiments described herein.
Figure 16A:
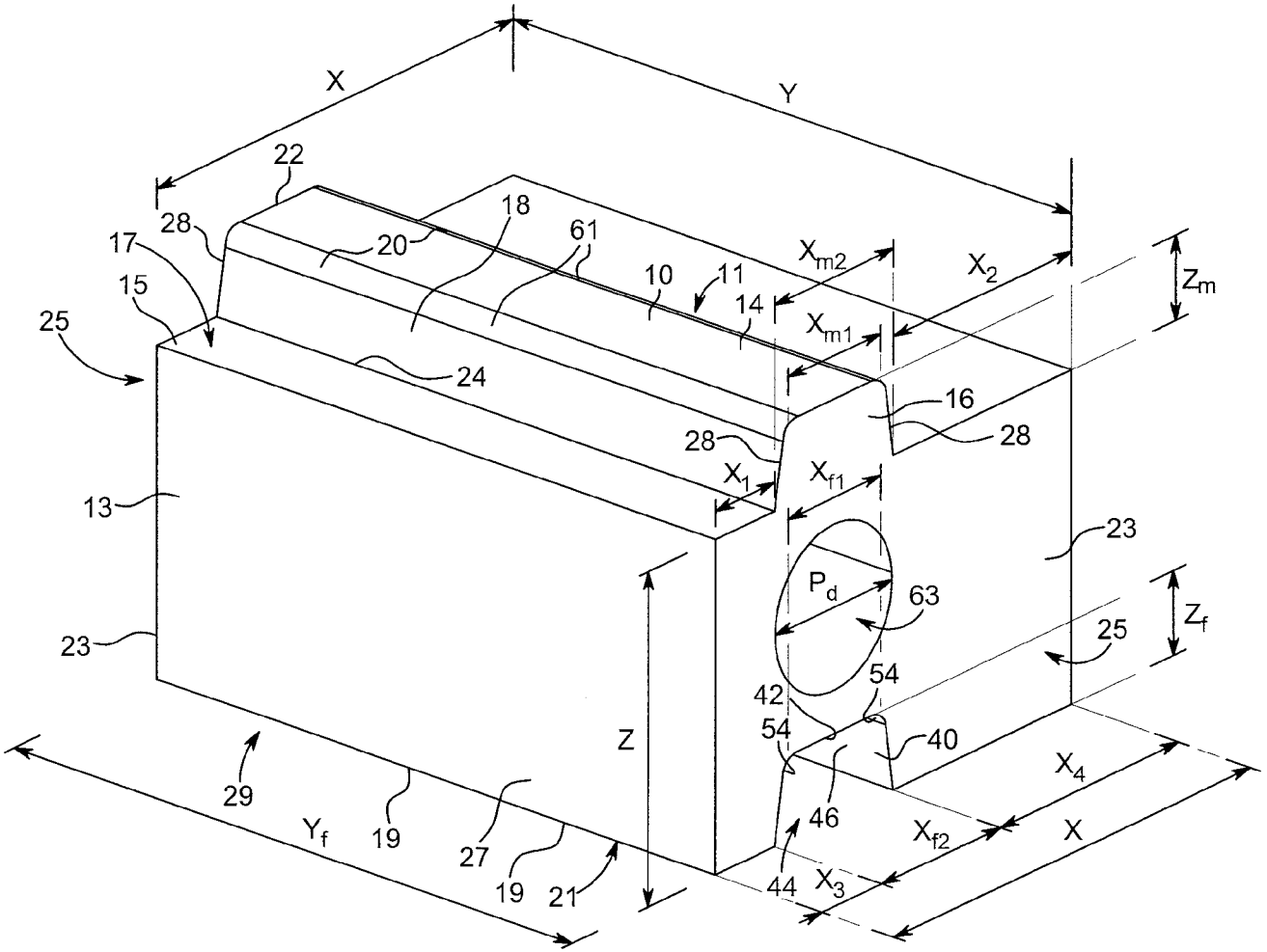
FIG. 16A is a perspective view of an offset foundation block for trusses according to various embodiments described herein.
Figure 16B:
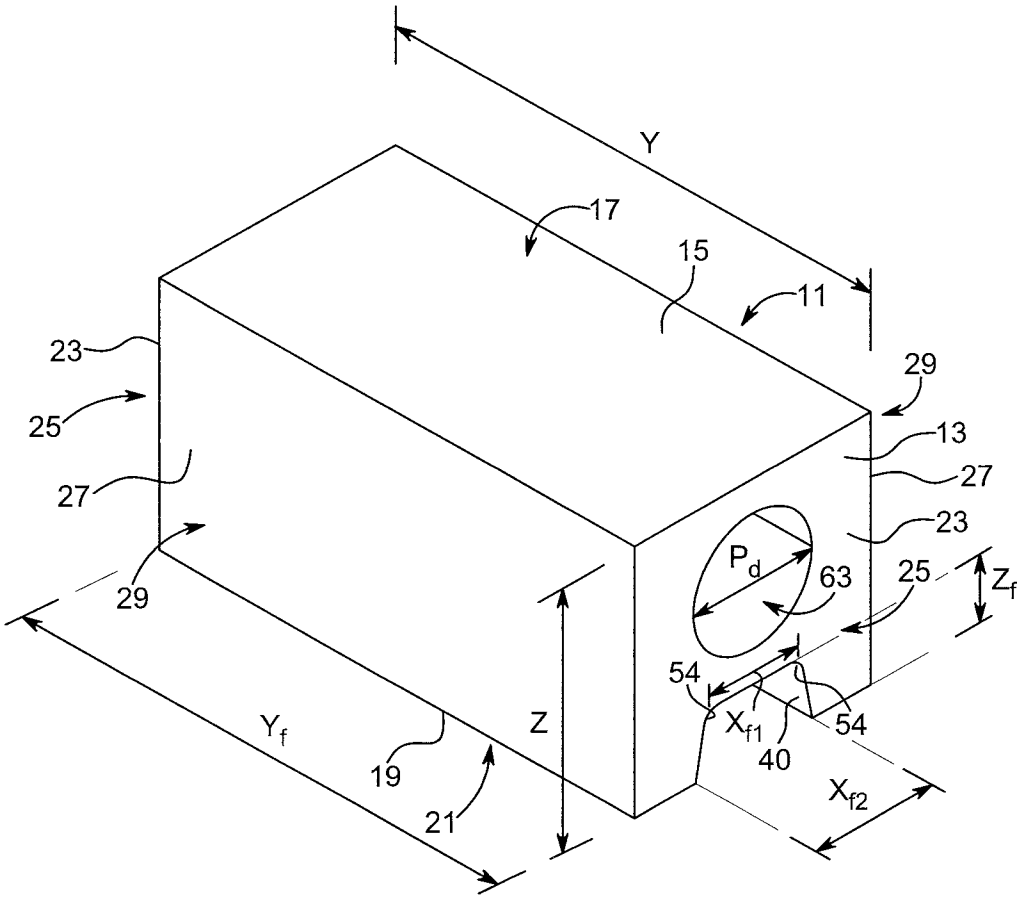
FIG. 16B is a perspective view of a block according to various embodiments described herein.

FIGS. 15-16B illustrate blocks 11 according to various embodiments. As above, for brevity, like features are identified with like numbers in these and other illustrated embodiments and descriptions of all features may not be repeated. The blocks 11 include dimensions configured to support accessory features, such as a hollow core portion comprising a passageway 63 defined through the block body 13, as described above with respect to FIGS. 9B-9C. Accessory features may include, for example, insulation, cabling, piping, deodorizers or even structural supporting materials. The passageway 63 may define a diameter $P_d$ and may be positioned equidistant from the upper face 15 of the block body 13 and the upper base 42 of the female fitting 40. The passageway 63 may also be laterally positioned equidistant between lateral side faces 18 of the male fitting 10 and the lower base opening 44 of the female fitting 40.

Beneficially, as introduced above, the passageway 63 may be utilized as a chase for placement of wiring, plumbing, air-conditioning, deodorizing, fumigating, lines, cables, information technology equipment or connections, insulation, fire-proofing, pumped concrete, etc. The chase may be utilized, for example, to facilitate vacuum systems, steam transmissions, vaccination transmission systems, lighting or any substances or objects that may benefit from the used of the passageway 63. In one embodiment, the system includes selling, leasing, or otherwise negotiating with utilities or other parties that desire to utilize the passageways 63. For example, an owner, builder, mason, or mason union may negotiate use of the system or passageways 63 to a trade such as electricians, plumbers, utilities, etc. for use of the passageways 63.

The male fitting 10 and female fitting 40 of the each of the blocks 11 illustrated in FIGS. 15 & 16A may include complementary dimensions such that if mated would be configured for interlocking interaction, as described above, e.g., as described with respect FIGS. 11 & 14. That is, the vertical lengths $Z_m$, $Z_f$ and lateral lengths $X_{m1}$, $X_{f1}$ and $X_{m2}$, $X_{f2}$ of the male fitting 10 and female fitting 40 may be substantially the same. In at least one embodiment, the longitudinal lengths $Y_f$ may be substantially the same as the longitudinal length of the male fitting 10.

In one non-limiting example, the blocks 11 configured as shown in FIGS. 15-16B may be configured to interface with the blocks 11 described above with respect to FIGS. 6-14. For example, the female fittings 40 of the blocks 11 illustrated in FIGS. 15-16B may comprise dimensions similar to those of the female fittings 40 described above and be configured for semi-interlocking interaction with male fittings 10 also similar to those described above. The male fittings 10 of the blocks 11 shown in FIGS. 15 & 16A may be configured for interlocking interaction with female fittings 40 having complementary dimensions, which may include blocks 11 configured similar to those described in FIGS. 6-14. For example, in one embodiment, a block configured according to any of FIGS. 15-16B may comprises a block body 13 dimensioned as described above, which may include configurations having various increased or reduced dimensions. The lateral lengths $X_1$, $X_2$ may be substantially the same and the lateral lengths $X_3$, $X_4$ may be substantially the same and correspond with $X_1$, $X_2$. Thus, the male fitting 10 and female fitting 40, if both present, may be positioned equidistant between adjacent lateral face 27 of the block body 13, as shown in FIG. 15.

The male and female fittings 40 may also be positioned offset from center, as shown in FIG. 16A, and comprise an offset foundation block for trusses configuration. The lateral lengths $X_2$, $X_4$ of lateral portions 41, 43 of the upper and lower faces 19 may extend a greater length than the lateral lengths $X_1$, $X_3$ of the lateral portion 41, 43. The offset block 11 may be configured to interface an additional block along respective upper and lower faces 15, 19. The lower face 19 of the additional block may extend the entire or less than the entire lateral length $X_2$. When used for a floor joist, the additional block may extend along a first portion of the lateral length $X_2$ adjacent to the male fitting 10 while leaving a suitable second portion of the lateral length $X_2$ available for receiving one or more floor joists thereon. Those skilled in the art will appreciate that intended application, joist selection, or associated engineering standards may direct, dictate, or specify suitable dimensions or surface characteristics of the second portion of the lateral length $X_2$ available for receiving one or more floor joists. For example, where three and a half inch floor joists seating is required, the offset block 11 may be configured such that the available second portion of the lateral length $X_2$, e.g., after the block 11 has been interfaced with an additional block, comprises a nominal lateral length of about four inches available to seat floor joists.

In various embodiments, blocks 11 may be configured with upper ends 17 or lower ends 21 that do not include a male keyway fitting 10 positioned at the upper or lower face 15, 19 or a female keyway fitting 40 defined in the upper or lower face 15, 16. The block configuration illustrated in FIG. 16B may be similar to the block configuration illustrated in FIG. 15 but without a male fitting positioned at the upper end 17 on the upper face 15. However, in at least one embodiment, the upper face includes a male fitting 10 positioned at the upper face 15 and does not include a female fitting 40 defined in the lower face 19.

In one illustrative example of dimensions that may be used in a configuration according to FIG. 15, 16A, or 16B, the block body 13 may comprise a longitudinal length Y of about sixteen inches and a vertical length of about eight inches. The lateral length X of the block body 13 may be about eight inches with respect to a configuration of FIG. 15 or FIG. 16B and about twelve inches with respect to a configuration of FIG. 16. In a configuration of FIG. 15 or FIG. 16B, the lateral lengths $X_1$, $X_2$, $X_3$, $X_4$ of lateral portions 41, 43 may be about two inches. The lateral lengths $X_2$, $X_4$ may be about six inches and lateral lengths $X_1$, $X_3$ may be about two inches in an offset configuration similar to FIG. 16A. The vertical lengths $Z_m$, $Z_f$ of the male and female fittings 10, 40 may be about two inches and the respective lateral lengths $X_{f2}$, $X_{m2}$ of the lower base opening 44 of the female fitting 40 and the lower base 14 of the male fitting 10 may be about four inches while the respective lateral lengths $X_{f1}$, $X_{m1}$ of the upper bases 42, 14 of the female fitting 40 and male fitting 10 may be about three and one eighth inches, taken between midpoints of respective arcuate edges 54, 61, both of which may include quarter rounded arcuate edges 54, 61, which may define about one half inch radii. However, those skilled in the art will appreciate that other dimensions may be suitably used. The passageway 63 may define a diameter $P_d$ of about four inches. The passageway 63 shown in FIG. 9D, for example, may define a vertical cross section $Z_c$ and a lateral cross section $X_c$ of about four inches. The passageway 63 may be positioned equidistant from the lateral sides 27 of the block body 13, as shown in FIGS. 15 & 16B, or may be laterally aligned with the lower base 14 of the male fitting 10 and the lower base opening 44 of the female fitting 40, as shown in FIGS. 15 & 16A.

Figure 17:
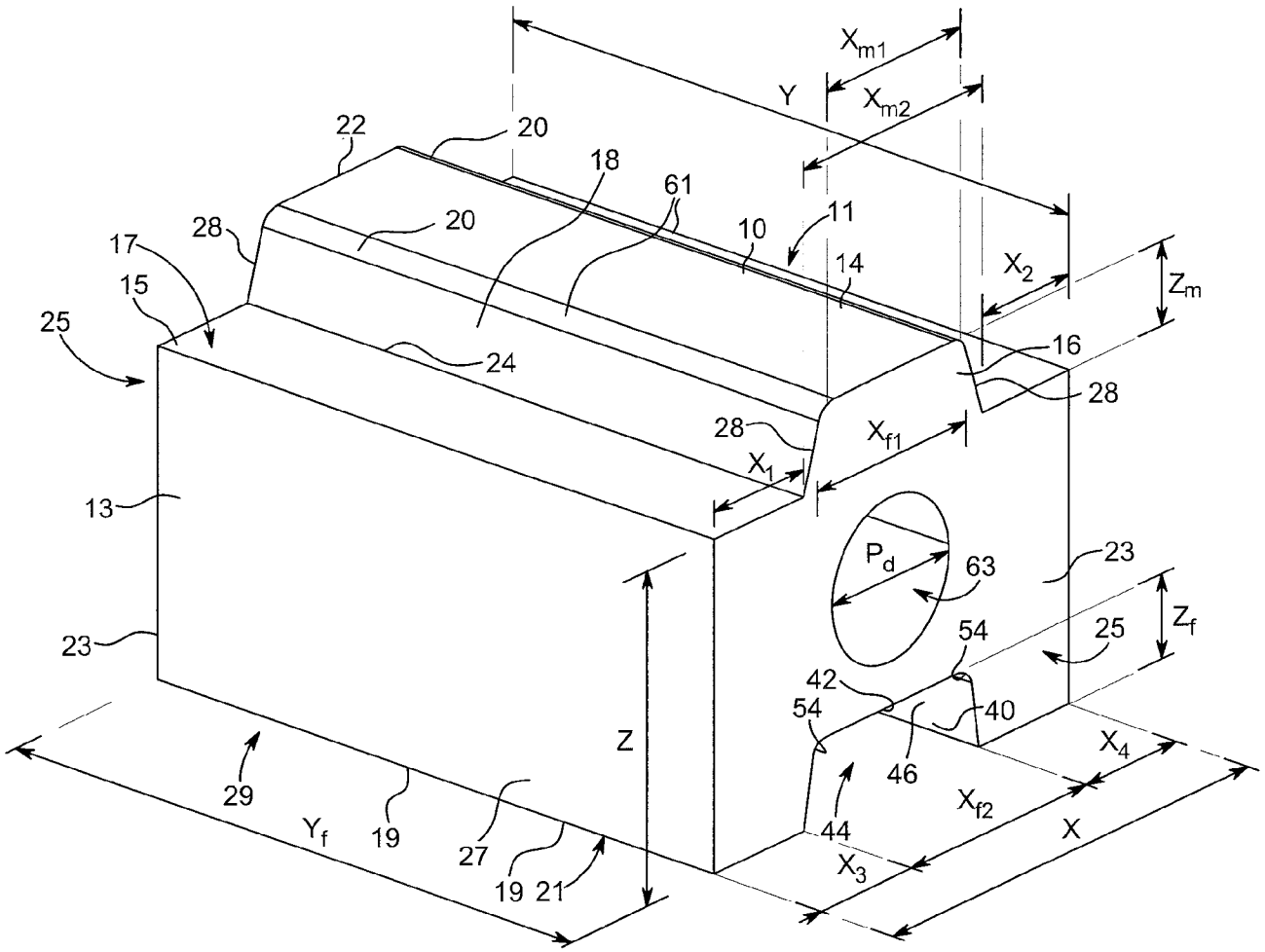
FIG. 17 is a perspective view of a block according to various embodiments described herein.

FIG. 17 illustrates a block 11 according to various embodiments. The block 11 includes a male fitting 10 that extends along the longitudinal length Y of the block body 13. The lateral side faces 18 of the male fitting 10 also define generally rectangular areas and have side edges 28 aligned along the longitudinal faces 23 of the block body 13. The side edges 28 couple the lateral side faces 18 and upper base 14 of the male fitting 10 also include arcuate edges 61. The arcuate edges 61 may extend about arcs having a radius similar to that of the arcuate edges 54 of the female fitting 40. The male fitting 10 and female fitting 40 may be configured for interlocking or semi-interlocking interaction. As shown, the vertical lengths $Z_f$, $Z_m$ and lateral lengths $X_{f2}$, $X_{m2}$ of the lower base opening 44 of the female fitting 40 and the lower base 12 of the male fitting 10 may be substantially the same while the lateral length $X_{f1}$ of the upper base 42 of the female fitting 40, taken between the midpoint of the arcuate edge 54, may be greater than the lateral length $X_{m1}$ of the upper base 14 of the male fitting 10.

In one illustrative non-limiting example of block dimensions that may be used in a configuration according to FIG. 17, the block body 13 may having a longitudinal length Y of about sixteen inches or about eight inches in a half block with respect to a reduce longitudinal dimension configuration. The lateral length X of about twelve inches and the vertical length Z may be about eight inches. The male fitting 10 and female fitting 40 may be positioned equidistant from adjacent the lateral faces 27 of the block body 13, at lengths $X_1$, $X_2$, $X_3$, $X_4$ of about three inches, for example. The vertical lengths $Z_f$, $Z_m$ may be about two inches and the lateral lengths $X_{f2}$, $X_{m2}$ of the lower base opening 44 of the female fitting 40 and the lower base 12 of the male fitting 10 may be about six inches while the lateral length $X_{f1}$ of the upper base 42 of the female fitting 40 may be about five and one eighth inches and the lateral length $X_{m1}$ of the upper base 14 of the male fitting 10 may be about four and one half inches, both taken between midpoints of the respective arcuate edges 54, 61, which may include quarter rounded arcuate edges 54, 61 defining one half inch radii. Thus, two blocks 11 having fittings dimensioned in a configuration according to FIG. 17 may be configured for semi-interlocking interaction when mated. The block 11 may also include a passageway 63 defined through the block body 13 configured to receive accessory features.

Continuing the illustrative example, the passageway 63 may define a diameter $P_d$ of about four inches. The passageway 63 may be positioned equidistant from the upper face 15 of the block body 13 and the upper base 42 of the female fitting 40 or about one inch from the upper face 15 and upper base 42. The passageway 63 is laterally aligned with the lower base opening 44 of the female fitting 40 and the lower base 12 of the male fitting.

Figure 18:
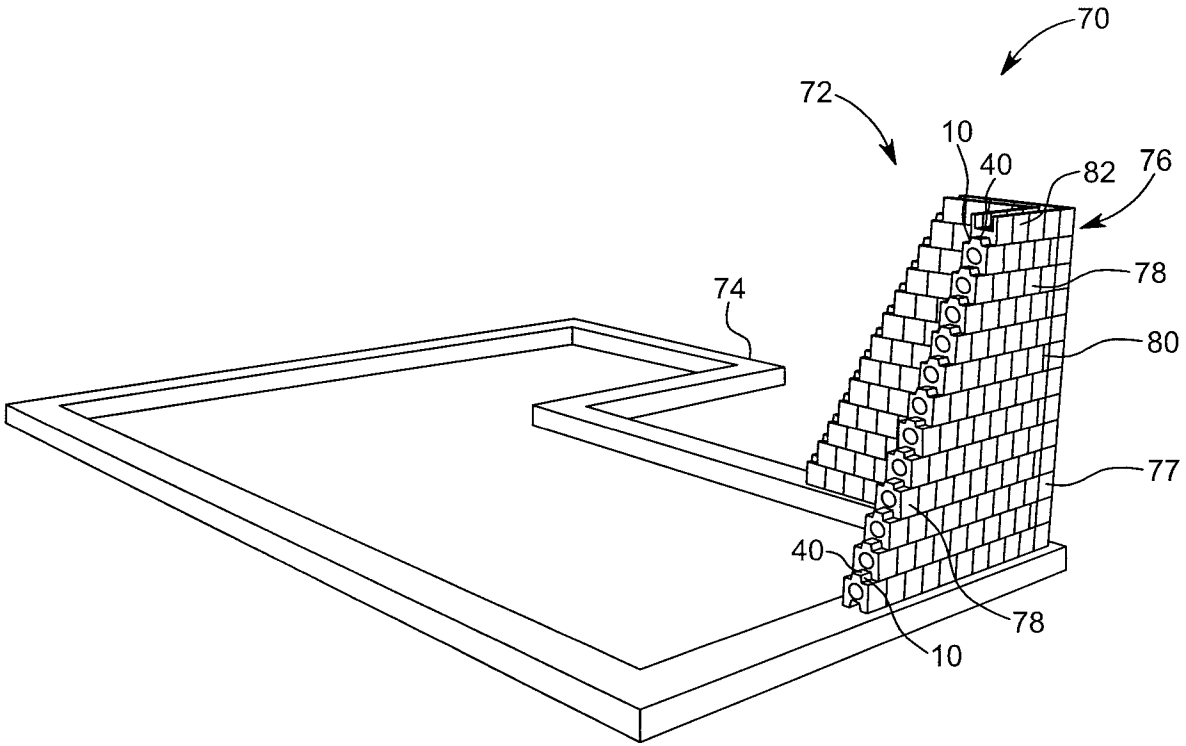
FIG. 18 illustrates a structure constructed using the block system according to various embodiments described herein.

FIG. 18 illustrates an application of the block system 70 according to various embodiments. The system 70 may include a block and column assembly 72 that may be constructed upon a foundation 74. A column may be constructed at a corner column 76 with corner blocks 77, which may include a plurality of interfaced column or corner column blocks, which may be similar to corner column blocks 11 described with respect to FIG. 9, may be stacked to form a corner 76. Column blocks 11, such as those described with respect to FIGS. 6-9, may also be incorporated into the structure to provide additional columns Additional assembly blocks 78 may be aligned and stacked outward and upward with respect to the corner 76. The blocks 78 may be interfaced by mating male fittings 10 and female fittings 40, as described herein.

The assembly blocks 78 are interfaced in an interlocking manner, e.g., such as with a plurality of blocks 78 similar to those described with respect to FIGS. 15 & 16B, or in a semi-interlocking manner, e.g., such as with a plurality of blocks 78 similar to those described with respect to FIG. 17. In some embodiments, the assembly blocks 78 may be interfaced in a manner that includes both interlocking and semi-interlocking interaction.

The assembly blocks 78 are further stacked in a staggered configuration via incorporation of blocks 80 having reduced longitudinal lengths Y, e.g., half blocks 80, positioned adjacent to the corner 76. The assembly blocks 78 include passageways 63 similar to the blocks 11 described above with respect to FIGS. 15-17. Tie-beam blocks 82, which may be similar to those described above with respect to FIGS. 13A-13E, may also be positioned on a row of assembly blocks 78 such that the female fittings 40 interface with the male fittings 10 in an interlocking or semi-interlocking manner.

Figure 19:
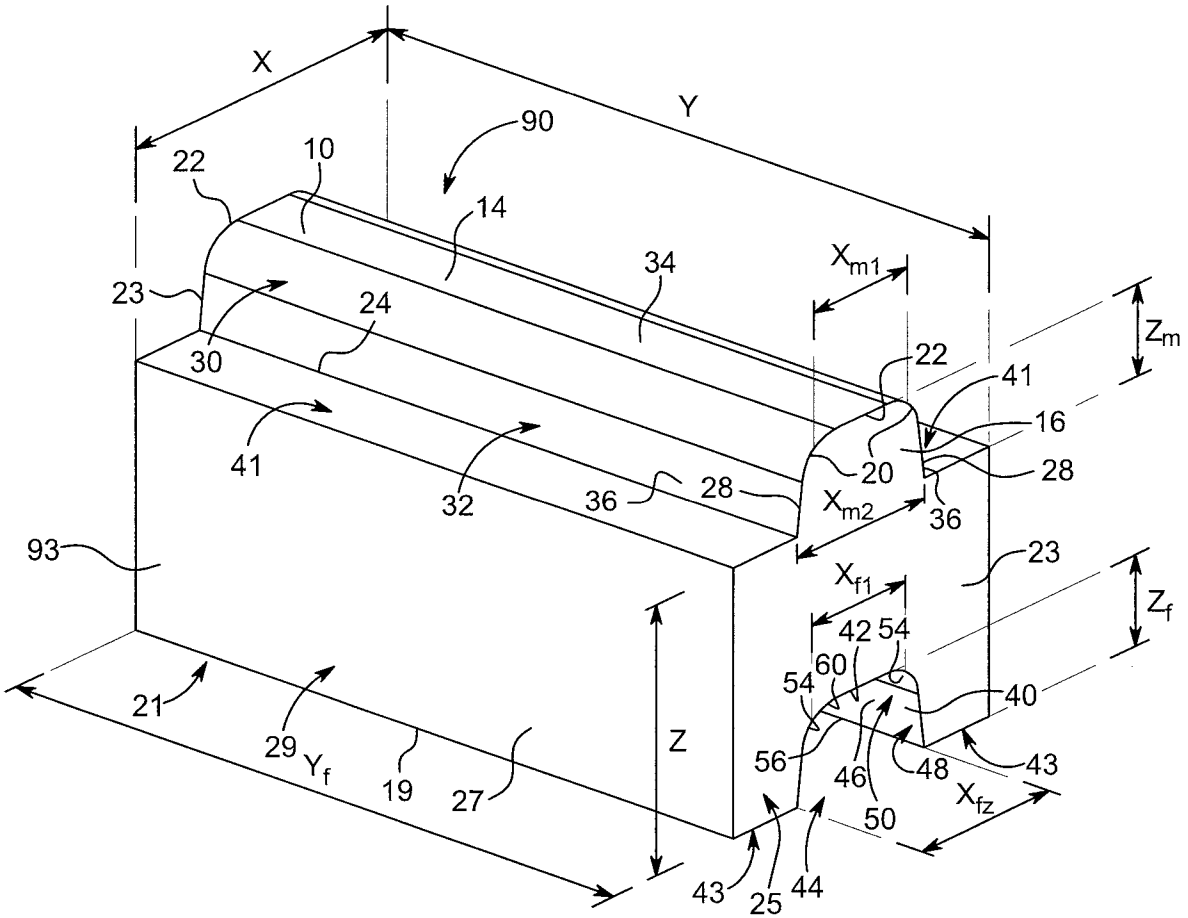
FIG. 19 is a perspective view of a brick according to various embodiments described herein.

FIG. 19 illustrates a brick configuration according to various embodiments. The brick 90 includes a brick body 93 having an upper face 15, a lower face 19, longitudinal faces 23, and lateral face 27. The brick includes male fitting 10 and a female fitting 40 extending the longitudinal length Y of the brick body 93. The male fitting 10 includes lateral side faces 18 that define generally rectangular areas and longitudinal side faces 16 aligned along the longitudinal faces 23 of the brick body 93. The lateral side faces 18 of the male fitting 10 couple to an upper base 14 of the male fitting 10 along arcuate edges 61. The female fitting 40 includes lateral side faces 46 coupled to an upper base 42 along arcuate edges 54, which may extend about arcs having a radius similar to that of the arcuate edges of the male fitting 10. In one embodiment, the arcuate edges 54 or 61 may include quarter rounded edges, which may arc about one and one half inch radii.

The male fitting 10 and female fittings 40 may be configured for interlocking or semi-interlocking fitment. As shown, the male fitting 10 and female fittings 40 are configured for semi-interlocking interaction. For example, the lateral length X of the male fitting 10 along the upper face 15 of the brick body and the lateral length $X_{f1}$ of the female fitting 40 along the lower face 19 of the brick body 93 may be substantially the same and the vertical lengths $Z_m$, $Z_f$ of the respective male and female fittings 10, 40 may also be substantially the same. The lateral length $X_{m1}$ of the upper base 14 of the male fitting 10 and the lateral length $X_{f1}$ of the upper base 42 of the female fitting 40 may differ such that the lateral length $X_{m1}$ of the upper base of the male fitting 10 is less than the lateral length $X_{f1}$ of the upper base 42 of the female fitting 40.

In one illustrative example of dimensions that may be used in a configuration according to FIG. 19, the brick body 93 includes standard brick dimensions, e.g., a lateral length X of about four inches, a vertical length Z of about three inches, and a longitudinal length Y of about eight inches, or as otherwise desired. The male fitting 10 and female fitting 40 may be positioned equidistant between the lateral face 27 of the brick body 93. The lateral lengths $X_{f2}$ of the male fitting 10 along the upper face 15 of the brick body 93 and the lateral length $X_{f2}$ of the female fitting 40 along the lower face 19 of the brick body 93 may be about two inches. The lateral length $X_{f1}$ of the upper base 42 of the female fitting 40 may be about one and seven sixteenth inches, taken from a midpoint of the arcuate edges 54. The lateral length $X_{m1}$ of the upper base 14 of the male fitting 10 may be about one and five sixteenth inches taken from a midpoint of the arcuate edges 61. In various embodiments, the arcuate edges 54, 61 may include quarter rounded edges having a radius of about one half inch.

Figure 20:
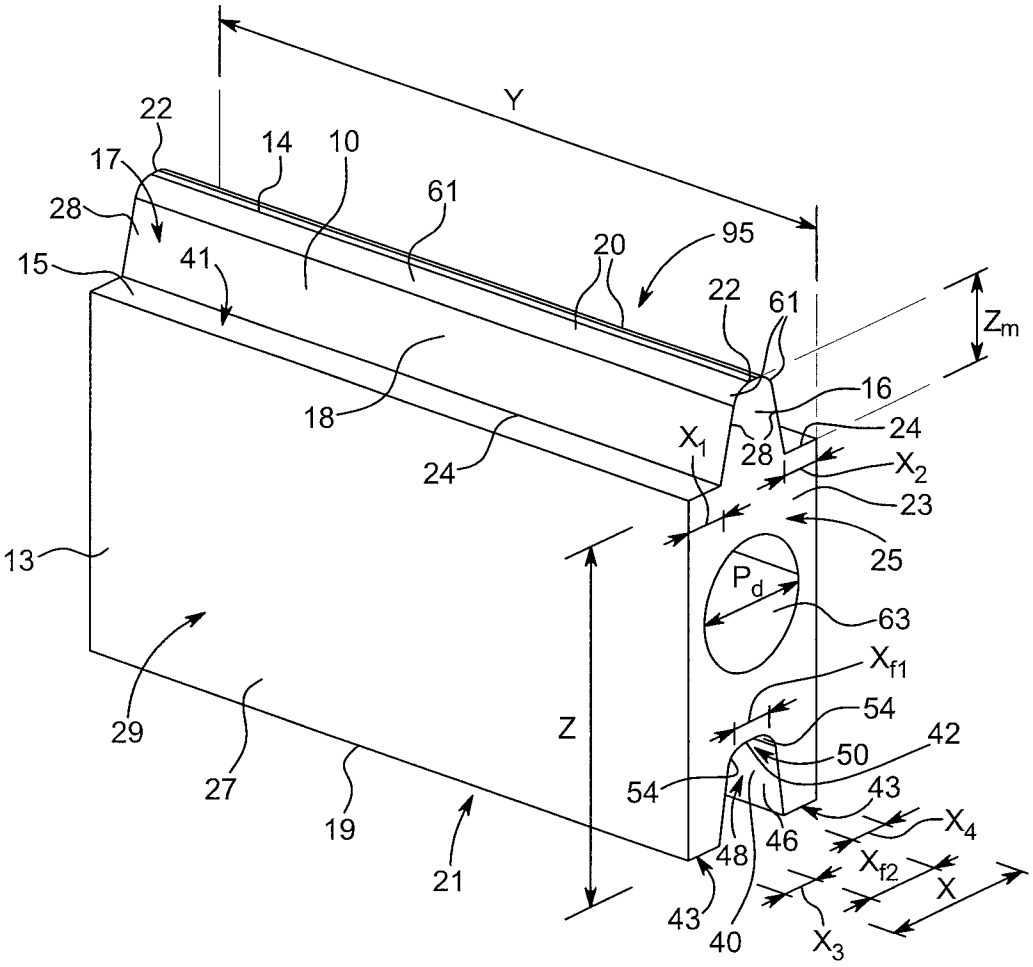
FIG. 20 is a perspective view of a wide block according to various embodiments described herein.

FIG. 20 illustrates a block 95 according to various embodiments. The block 95 includes a block body 13 having an upper face 15 and a lower face 19, longitudinal faces 23, and lateral faces 27. A male fitting 10 is positioned along the upper face 15 and a female fitting 40 is defined at the lower face 19. The male fitting 10 includes a prism shape having a generally rectangular upper base 14, lower base 12, and lateral side faces 18. The male fitting 10 further includes generally trapezoidal shaped longitudinal side faces 16. The upper base 14 and longitudinal side faces 18 meet along lateral upper edges 20 comprising arcuate edges 61. The male fitting 10 may include an arcuate upper base 14 that extends to lateral side faces 18. The arcuate edges 61 may include a pair of quarter rounded arcs. The female fitting 40 includes an upper base 42 coupled to lateral side faces 46 along arcuate edges 54. A lower base opening 44 is defined along the lower face 19 of the block body 13 between the lateral side faces 46 for receiving a male fitting 10. The arcuate edges 54 may include a pair of quarter rounded arcs.

Figure 21:
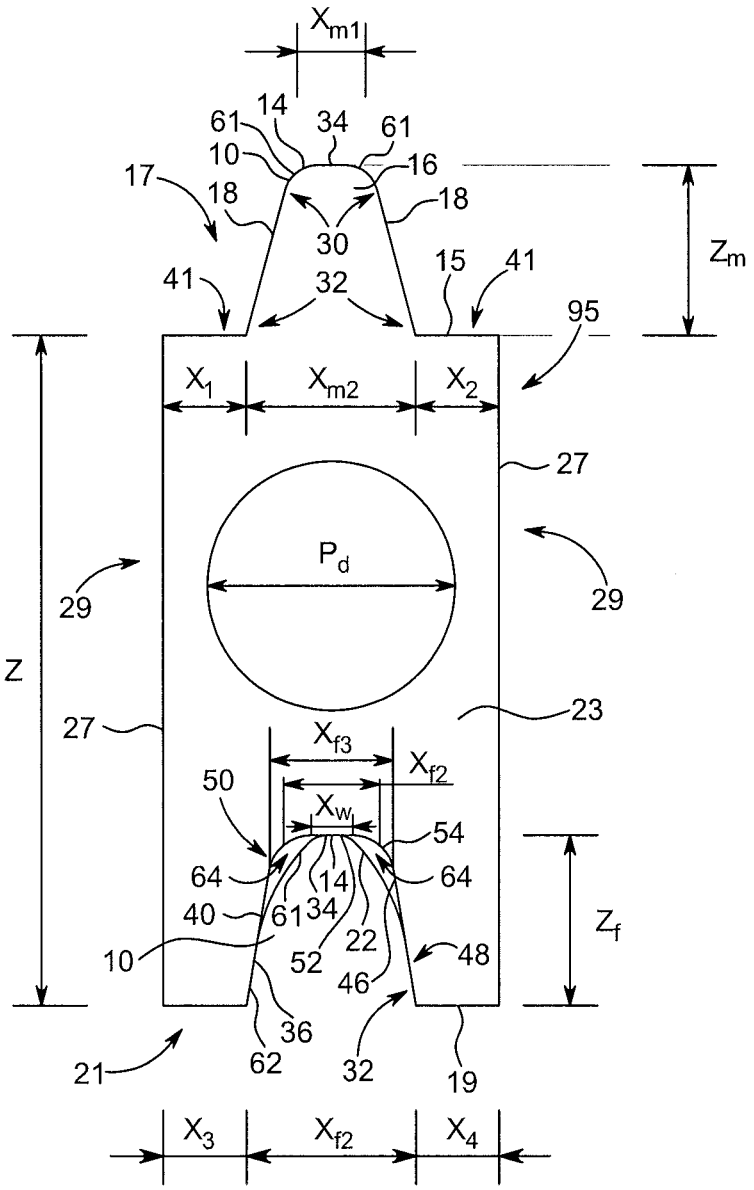
FIG. 21 illustrates a side view of the block illustrated in FIG. 20 mated with a male fitting having dimensions corresponding to the male fitting of the block.

FIG. 21 illustrates a side view of the block 95 illustrated in FIG. 20 mated with a male fitting 10 having dimensions corresponding to the male fitting 10 formed at the upper face 15 of the block body 13 of the block 95. The male fitting 10 and female fitting 40 may be dimensioned for semi-interlocking interaction in manner similar to the fittings described above.

In one non-limiting example, the vertical length Z of the block body 13 may be about eight inches and lateral length X may be about four inches. The diameter $P_d$ of the passageway 63 may be about three inches. The vertical lengths $Z_m$, $Z_f$ of the male and female fittings 40 may be about two inches, and the lateral lengths $X_{m2}$, $X_{f2}$ between the lower ends 32, 48 of the sides faces 16 and side faces 46 (along the respective upper face 15 and lower face 19 of the block body 13) may be about two inches. Lateral portions 41, 43 of the upper and lower faces 15, 19 positioned between the fittings 10, 40 and adjacent lateral faces 27 of the block body 13 may include lateral lengths $X_1$, $X_2$, $X_3$, $X_4$ of about one inch. The lateral side faces 18 of the male fitting 10 and the side faces 46 of the female fitting 40 may be configured to engage along engagement surfaces 36, 62 positioned along their respective lower portions 30, 50. The upper base 14 of the male fitting 10 includes an engagement surface 34 configured to engage an engagement surface 60 along the female fitting 40. The lateral length $X_w$ of the engagement surfaces 34, 60 along which the upper bases 14, 42 of the male and female fitting 10, 40 engage may be about one half inch. The lateral length $X_{m2}$ of upper base 14 of the male fitting 10 taken between the midpoints of the arcuate edges 61 may be about thirteen sixteenth inches and the lateral length $X_{f2}$ of the upper base 42 of the female fitting 40 taken between the midpoints of the arcuate edges 54 may be about one and one eighth inches. The lateral length $X_{f3}$ along the upper base 42 and the arcuate edges 54 of the female fitting may be about one and one half inches. The arcuate edges 61 of the male fitting 10 and the arcuate edges 54 of the female fitting 40 may have arcs defining about one half inch radii; however, other dimensions may be used. Accordingly, a pair of longitudinally extending gaps 64 may be defined between the lateral side faces 18 of the male fitting 10 and the side faces 46 of the female fitting 40 when the male and female fittings 40 are mated.

Figure 22:
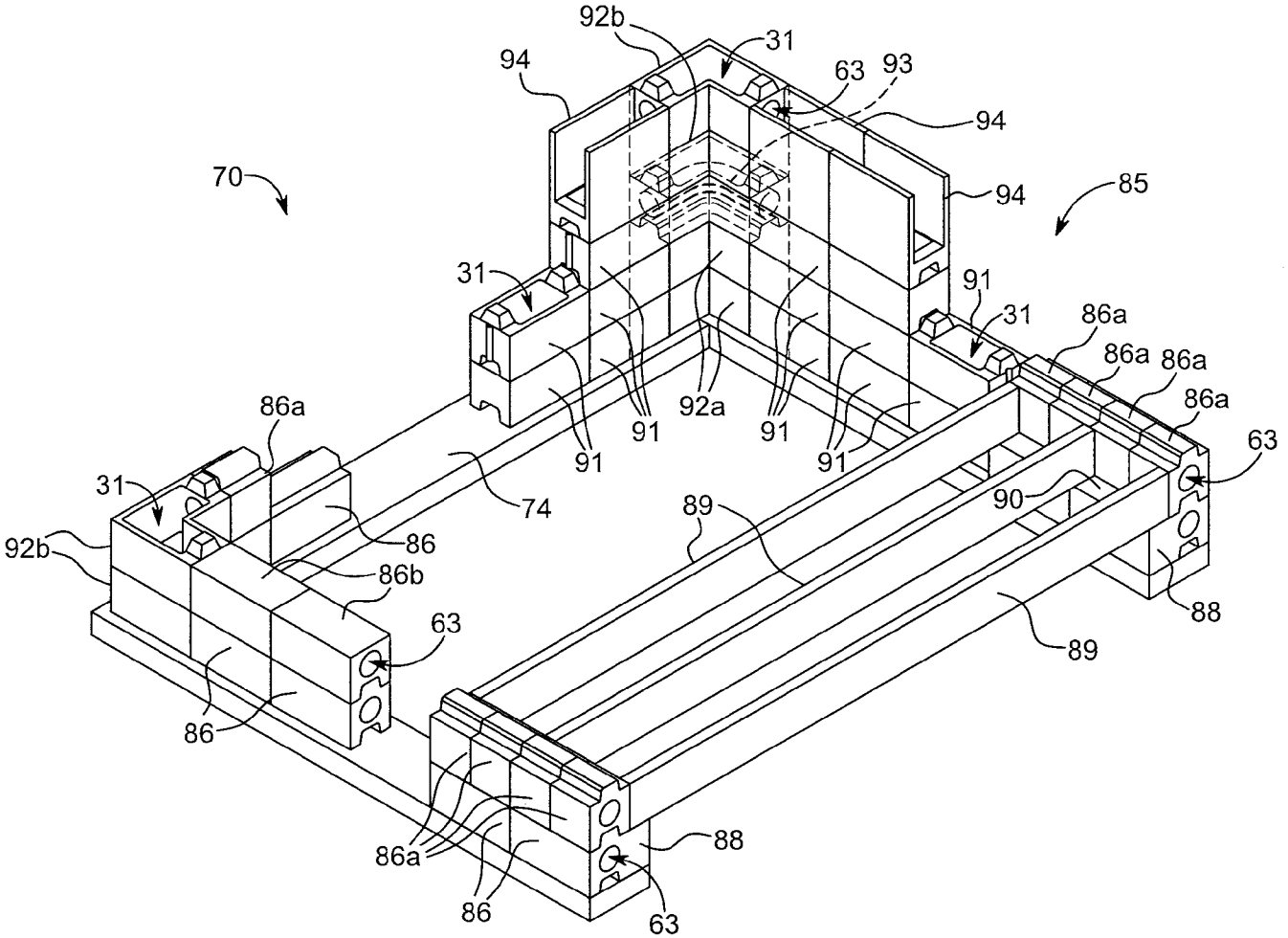
FIG. 22 illustrates another structure constructed using the block system according to various embodiments described herein.

FIG. 22 illustrates block interactions of the block system 70 according to various embodiments. The system 70 may include any combination of the herein described blocks. The blocks may be aligned, arranged, and stacked by interfacing adjacent surfaces including mating of male fittings and female keyway fittings or arcuate side fittings, as described herein. It will be appreciated by those skilled in the art that the system 70 has wide ranging applicability, and the example structure 85 is intended to merely illustrate some of the beneficial interactions that may be utilized to construct structures using the system 70 and associated blocks. The structure 85 may be constructed on a surface or foundation 74 for positioning of the blocks of the system 70.

Keyway blocks 86 comprising male and female keys and keyway fittings that extend the length of their respective block body are shown positioned on the foundation 74. The keyway blocks 86 may be similar to the blocks 11 described with respect to FIGS. 15 & 17. As shown, one or more of the keyway blocks 86 may also define horizontally extending accessory passageways 63. However, in some applications, keyway blocks 86 that do not include horizontally extending accessory passageways 63 may be used. Keyway blocks 86*a* having reduced block dimensions, e.g., reduce longitudinal length, compared to keyway blocks 86 are also shown interfaced with system 70 blocks. Additional keyway blocks 86*b* comprising single keyways are also shown. While only keyway blocks 86*b* defining a female keyway fitting and having an opposite flat surface, similar to the block 11 described with respect to FIG. 16B, are shown, it will be appreciated that keyway blocks having only a male key fitting may also be used. Indeed, in various embodiments, any of the blocks herein described may include only a male key fitting or female keyway fitting at the upper or lower surface of the block body wherein the remaining opposite surface comprising a flat surface. Flat surfaces may used, for example, to provide increased surface area or stability when interfaced with surfaces that do not include a key or keyway, e.g., along flat foundation, bedrock, or flooring or for placement of beams, girders, or joists. Keyway blocks 88 having offset dimensions, and which may be similar to those described with respect to FIG. 16A, are also shown supporting a beam or girder 89 along their extended upper surfaces 90.

Various column blocks 91 and corner column blocks 92*a*, 92*b* defining vertical passageways 31 are also shown stacked along the foundation 74. The column blocks 91 may be similar to the blocks 11 described with respect to FIGS. 6-8. The corner column blocks 92*a* may be similar to the corner block 11 described with respect to FIG. 9A. The corner column blocks 92*b* may define a horizontal accessory passageway 63 at each longitudinal face, similar to the block 11 described with respect to FIG. 9B. Another corner block 93 is shown interfaced with the column blocks 91, 92*a*, 92*b* and which defines a horizontal accessory passageway 63. The corner block 93 may be similar to the block 11 described with respect to FIG. 9C. Tie-beam blocks 94, which may be similar to those described above with respect to FIGS. 13A & 13B, are also shown stacked on the column blocks 91, however, other configurations, such as interfacing in locking or semi-interlocking interaction with keyway blocks 86, for example, may be used. Any of the system blocks 11, 86-88, 91-94 may include male or female arcuate side fittings at one or more longitudinal ends, as described above with respect to FIGS. 7 & 8, to provide additional impact characteristics. Additionally, any of the system blocks 11, 86-88, 91-94 may be configured for locking or semi-interlocking interaction in consideration of the desired application of the block 11, 86-88, 91-94.

In various embodiments, a method of making blocks 11 as described herein includes forming a mold, e.g., frame or negative form, in which the block material may be provided or pressed. The mold may comprise a single section or multiple sections for a single block 11 or multiple blocks 11 that may be formed in parallel. The material may be positioned, e.g., injected, poured, sprayed, layered, etc., into the mold or section thereof. In one embodiment, the mold comprises positional mold sections. For example, one or more mold sections may be positioned by hydraulic arms. Such mold sections may be removed after suitable formation of the block 11, e.g., by the hydraulic arm. In one embodiment, a hydraulic arm may position multiple sections each corresponding to a different block 11 or block mold.

Various block dimensions are described herein in non-limiting examples to assist the reader in understanding the various beneficial aspects. Those having skill in the art will appreciate upon reading the present disclosure that various dimensions may be increased or decreased without departing from the various beneficial aspects. Similarly, ratios may be determined from the dimensions provided in the examples, any of which are to be considered specifically identified herein, and may similarly be appropriately increased or decreased without departing from the beneficial aspects described herein.

This disclosure describes various elements, features, aspects, and advantages of various embodiments of the stopping systems, apparatuses, and methods thereof. It is to be understood that certain descriptions of the various embodiments have been simplified to illustrate only those elements, features and aspects that are relevant to a more clear understanding of the disclosed embodiments, while eliminating, for purposes of brevity or clarity, other elements, features and aspects. Any references to "various embodiments," "certain embodiments," "some embodiments," "one embodiment," or "an embodiment" generally means that a particular element, feature and/or aspect described in the embodiment is included in at least one embodiment. The phrases "in various embodiments," "in certain embodiments," "in some embodiments," "in one embodiment," or "in an embodiment" may not refer to the same embodiment. Furthermore, the phrases "in one such embodiment" or "in certain such embodiments," while generally referring to and elaborating upon a preceding embodiment, is not intended to suggest that the elements, features, and aspects of the embodiment introduced by the phrase are limited to the preceding embodiment; rather, the phrase is provided to assist the reader in understanding the various elements, features, and aspects disclosed herein and it is to be understood that those having ordinary skill in the art will recognize that such elements, features, and aspects presented in the introduced embodiment may be applied in combination with other various combinations and sub-combinations of the elements, features, and aspects presented in the disclosed embodiments. It is to be appreciated that persons having ordinary skill in the art, upon considering the descriptions herein, will recognize that various combinations or sub-combinations of the various embodiments and other elements, features, and aspects may be desirable in particular implementations or applications. However, because such other elements, features, and aspects may be readily ascertained by persons having ordinary skill in the art upon considering the description herein, and are not necessary for a complete understanding of the disclosed embodiments, a description of such elements, features, and aspects may not be provided. As such, it is to be understood that the description set forth herein is merely exemplary and illustrative of the disclosed embodiments and is not intended to limit the scope of the invention as defined solely by the claims.

It will be further appreciated that for conciseness and clarity, spatial or relative terms such as "vertical," "horizontal," "upper," "lower," "lateral," "longitudinal," and others may be used herein with respect to the illustrated embodiments. However, blocks 11 may be used in many orientations and positions, and these terms are not intended to be limiting and absolute.

All numerical quantities stated herein are approximate unless stated otherwise, meaning that the term "about" may be inferred when not expressly stated. The numerical quantities disclosed herein may be nominal numerical quantities and are to be understood as not being strictly limited to the exact numerical values recited. Instead, unless stated otherwise, each numerical value is intended to mean both the recited value and a functionally equivalent range surrounding that value. All numerical ranges stated herein include all sub-ranges subsumed therein. For example, a range of "1 to 10" is intended to include all sub-ranges between and including the recited minimum value of 1 and the recited maximum value of 10. Any maximum numerical limitation recited herein is intended to include all lower numerical limitations. Any minimum numerical limitation recited herein is intended to include all higher numerical limitations. Additionally, in some illustrative embodiments, dimensions including a parameter, measurement, diversion, or range may be given. It is to be understood that any such parameter, measurement, diversion, or range is provided as an illustrative example or instance of an embodiment and is not intended to limit that or other embodiments. For example, unless otherwise specified, illustrations of dimensions and how such parameters or measurements of such dimensions relate to other parameters, e.g., with respect to movement, support, engagements, interfacing dimensions are provided to aid the reader's understanding of the features and may not be illustrated to scale nor universally applicable to every embodiment.

What is claimed is:

1. A semi-interlocking construction block system, the block system comprising:

a first block having a prism shaped male fitting positioned at a first face of the first block, the male fitting comprising lateral and longitudinal lower edges extending along the first face of the first block and defining a lower base, lateral and longitudinal upper edges defining an upper base, lateral side faces having lower ends extending from the lateral lower edges and upper ends extending to the lateral upper edges, and longitudinal side faces having lower ends extending from the longitudinal lower edges and upper ends extending to the lateral upper edges; and a second block having a prism shaped female fitting defined in a first block face of the second block, the female fitting comprising lateral lower edges extending along the first face of the second block between longitudinal ends of the female fitting and defining a lower base opening therebetween, lateral side faces extending between the longitudinal ends of the female fitting and having lower ends extending from the lateral lower edges and upper ends extending to arcuate lateral upper edges, and an upper base extending between the longitudinal ends and the arcuate lateral upper edges;

wherein, when mated, the male and female fittings engage along respective upper bases and lower ends of the lateral side faces and gaps are defined between the upper ends of the lateral side faces of the male fitting and the arcuate lateral upper edges and the upper ends of the lateral side faces of the female fitting.

2. The block system of claim 1, wherein the lateral upper edges of the male fitting are arcuate, wherein the first face of the first block extends between a first and a second longitudinal end of the first block, and wherein the male fitting extends along the first face of the first block between the first and second longitudinal ends.

3. The block system of claim 2, wherein the first block, the second block, or both further comprises a passageway extending longitudinally through the block, wherein the passageway defines a cross-section, wherein the cross-section is arcuate or rectangular.

4. The block system of claim 1, wherein the second block further comprises extensions extending from a second face of the second block, opposite of the first, and wherein the extensions define a slot dimensioned to receive a beam.

5. The block system of claim 4, wherein the second block further defines a hollow core extending between the first face and the second face of the second block, and wherein the hollow core is configured to receive a column therein transverse to the beam.

6. The block system of claim 1, wherein the longitudinal side faces of the male fitting are trapezoidal shaped.

7. The block system of claim 6, wherein the lateral side faces of the male fitting are trapezoidal shaped, and wherein the gaps further extend along the upper and lower ends of the longitudinal side faces of the male fitting when mated.

8. The block system of claim 1, wherein the male fitting is located at a first end of the first face of the first block, wherein the first block further comprises a second male fitting, same as the first, located at a second end of the first face of the first block, and wherein the first block further comprises a hollow core positioned between the male fittings and extending between the first face and a second face of the first block, opposite the first, dimensioned to receive a column.

9. The block system of claim 8, wherein the female fitting is located at a first end of the first face of the second block, wherein the second block further comprises a second female fitting, same as the first, located at a second end of the first face of the second block and positioned to mate with the second male fitting of the first block, and wherein the second block further comprises a hollow core positioned between the female fittings and extending between the first face and a second face of the second block, opposite the first, and configured to align with the hollow core of the first block when the male and female fittings mate.

10. The block system of claim 9, wherein the hollow cores of the first and second block comprise arcuate edges.

11. The block system of claim 1, wherein both the first block and second block have a second face, opposite their respective first face, and wherein at least one of the second face of the first block or the second face of the second block does not define a corresponding male or female fitting.

12. The block system of claim 11, wherein the at least one of the second face or the first block and the second face of the second block that does not define a corresponding male or female fitting defines a substantially flat surface extending along its lateral and longitudinal length.

13. The block system of claim 1, wherein the male fitting is laterally offset along the first face.

14. The block system of claim 1, wherein both the first block and the second block have a second face, opposite the first, and opposing third and fourth faces extending between the first face and the second face, wherein the third face and the fourth face of at least one of the first block and the second block respectively define an outer corner and an inner corner.

15. A construction block configured for semi-interlocking interaction, the block comprising:

a block body having a first face positioned at a first end and a second face positioned at a second end;

a prism shaped male fitting protruding from the first face, the male fitting comprising lateral and longitudinal lower edges extending along the first face, lateral and longitudinal side faces having lower ends and upper ends, wherein the lower ends extend from respective lateral and longitudinal lower edges and the upper ends extend to respective lateral and longitudinal upper edges, and an upper base defined between the lateral and longitudinal upper edges and positioned a first vertical distance from the first face, wherein the lateral and longitudinal side faces are trapezoidal and a perimeter of the lateral and longitudinal lower edges is greater than a perimeter of the lateral and longitudinal upper edges; and a female fitting defined in the second face, wherein the female fitting comprises lateral lower edges extending along the second face and defining a lower base opening therebetween, lateral side faces extending between longitudinal ends of the female fitting and having lower ends extending from the lateral lower edges and upper ends extending to arcuate lateral upper edges, and an upper base positioned a second vertical distance from the second face and extending between the longitudinal ends and the arcuate lateral upper edges;

wherein the first and second vertical distances are substantially the same, wherein a distance between the lower ends of the lateral side faces of the female fitting is substantially the same as a distance between the lower ends of the lateral side faces of the male fitting, and wherein a distance between the upper ends of the lateral side faces of the female fitting is greater than a distance between the upper ends of the lateral side faces of the male fitting.

16. The block of claim 15, wherein the block further defines a hollow core extending between the first face and the second face, and wherein the hollow core is configured to receive a column therein.

17. The block of claim 15, wherein the male fitting and female fitting are laterally offset along the first face and the second face.

18. The block of claim 15, wherein the block has opposing third and fourth faces extending between the first face and the second face, wherein the third face defines an outer corner and the fourth face defines an inner corner.

19. A method of forming a structure, the method comprising:

positioning a first block and a second block in semi-interlocking engagement comprising mating a prism shaped male fitting of the first block and a prism shaped female fitting of the second block;

wherein the male fitting is formed on a first face of the first block and comprises lateral and longitudinal lower edges extending along the first face of the first block and defining a lower base, lateral and longitudinal upper edges defining an upper base, lateral side faces having lower ends extending from the lateral lower edges and upper ends extending to the lateral upper edges, and longitudinal side faces having lower ends extending from the longitudinal lower edges and upper ends extending to the lateral upper edges;

wherein the female fitting is defined in a first block face of the second block and comprises lateral lower edges extending along the first face of the second block between longitudinal ends of the female fitting and defining a lower base opening therebetween, lateral side faces extending between the longitudinal ends of the female fitting and having lower ends extending from the lateral lower edges and upper ends extending to arcuate lateral upper edges, and an upper base extending between the longitudinal ends and the arcuate lateral upper edges; and wherein, when mated, the male and female fittings engage along respective upper bases and lower ends of the lateral side faces and gaps are defined between the upper ends of the lateral side faces of the male fitting and the arcuate lateral upper edges and the upper ends of the lateral side faces of the female fitting.

20. The method of claim 19, further comprising applying an adhesive to one or both of the male fitting and the female fitting prior to mating the male fitting and female fitting, wherein, when mated, at least a portion of the adhesive is positioned within the gaps defined between the upper ends of the lateral side faces of the male fitting and the arcuate lateral upper edges and the upper ends of the lateral side faces of the female fitting.

* * * * *